US010649373B2

(12) United States Patent
Konno

(10) Patent No.: US 10,649,373 B2
(45) Date of Patent: May 12, 2020

(54) IMAGE FORMING APPARATUS WITH CLEANING UNIT AND JAM DETECTION

(71) Applicant: CANON KABUSHIKI KAISHA, Tokyo (JP)

(72) Inventor: Yuya Konno, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/371,355

(22) Filed: Apr. 1, 2019

(65) Prior Publication Data

US 2019/0310570 A1 Oct. 10, 2019

(30) Foreign Application Priority Data

Apr. 5, 2018 (JP) ..... 2018-073417

(51) Int. Cl.
*G03G 15/00* (2006.01)
*G03G 15/095* (2006.01)
*G03G 21/00* (2006.01)

(52) U.S. Cl.
CPC ..... *G03G 15/095* (2013.01); *G03G 15/5012* (2013.01); *G03G 21/0064* (2013.01)

(58) Field of Classification Search
CPC ..... G03G 15/5012; G03G 15/161; G03G 15/168; G03G 15/70; G03G 15/703
USPC ..... 399/19–21, 101
See application file for complete search history.

(56) References Cited

U.S. PATENT DOCUMENTS

| | | | | |
|---|---|---|---|---|
| 9,645,528 | B2 * | 5/2017 | Minato | G03G 15/161 |
| 10,054,895 | B2 * | 8/2018 | Nakagaki | G03G 15/70 |
| 2014/0044445 | A1 | 2/2014 | Kihara et al. | |

FOREIGN PATENT DOCUMENTS

| | | | |
|---|---|---|---|
| JP | S61-002165 | A | 1/1986 |
| JP | 2004-245954 | A | 9/2004 |
| JP | 2014-038119 | A | 2/2014 |
| JP | 2014-186077 | A | 10/2014 |

* cited by examiner

*Primary Examiner* — William J Royer
(74) *Attorney, Agent, or Firm* — Venable LLP

(57) ABSTRACT

In a case where a sheet jam detection unit detects that a sheet jam has occurred in an image bearing member, and determines that there is no sheet P at a nip portion, a printer control unit starts cleaning by a cleaning unit without waiting for removal of the sheet P causing the sheet jam.

15 Claims, 14 Drawing Sheets

IMAGE FORMING APPARATUS WITH CLEANING UNIT AND JAM DETECTION

BACKGROUND OF THE INVENTION

Field of the Invention

The present invention relates to an image forming apparatus, and more particularly relates to an image forming apparatus that forms an image by an electrophotography system, and transfers the formed image to a recording medium.

Description of the Related Art

Conventionally, in a color image forming apparatus of the electrophotography system, the configuration is adopted in which images are sequentially transferred from imaging parts of respective colors to an intermediate transfer body, and further, the images are collectively transferred from the intermediate transfer body to a recording medium. In such an image forming apparatus, in a case where a sheet jam of the recording medium, a door opening/closing, an abnormal operation of a unit in the image forming apparatus, etc. are detected during a printing operation, the image forming apparatus stops an image forming operation in a state where toner images before being transferred to the recording medium remain in the imaging parts and the intermediate transfer body. Hereinafter, the toner image before being transferred to the recording medium is referred to as an untransferred toner. In that case, in order to prevent an image defect due to the untransferred toner, the image forming apparatus performs a cleaning operation of the untransferred toner on the imaging parts of respective colors and the intermediate transfer body, before the image forming apparatus resumes the image forming operation after the recording medium that caused the sheet jam is removed by a user. Since the image forming operation can be resumed after the cleaning operation is completed, a waiting time for the user until the image forming operation is completed will be extended for the time period required for the cleaning operation. Meanwhile, a method is disclosed that reduces the time period required for the cleaning operation by setting a voltage applied to an image forming unit to a value adjusted for the cleaning operation at the time of the cleaning operation (see, for example, Japanese Patent Application Laid-Open No. 2014-038119).

Although the time period required for the cleaning operation is reduced in conventional technologies, the cleaning operation is performed after the recording medium that caused the sheet jam is removed by the user. Therefore, the user will be kept waiting for the time period required for the cleaning operation until the image forming operation is resumed after the user notices the sheet jam and removes the recording medium.

SUMMARY OF THE INVENTION

Under such circumstances, an aspect of the present invention is an image forming apparatus that reduces the waiting time for the user until the image forming operation is resumed after the image forming operation is interrupted.

Another aspect of the present invention is an image forming apparatus including: a conveyance unit provided on a conveyance path, and configured to convey a recording medium; an image bearing member configured to bear a toner image to be transferred to the recording medium; a transfer unit configured to transfer the toner image borne by the image bearing member to the recording medium at a transfer position; a cleaning unit configured to clean a toner on the image bearing member; a detection unit configured to detect that a jam of the recording medium occurs on the conveyance path; and a control unit configured to control the conveyance unit to stop driving of the conveyance unit, in a case where the detection unit detects that the jam occurs, wherein, in a case where the detection unit detects that the jam occurs, and the control unit determines that the recording medium does not exist at the transfer position, the control unit allows the cleaning unit to start cleaning without waiting for removal of the recording medium causing the jam.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An embodiment according to the present invention will be described in detail below with reference to the drawings. However, the components described in this embodiment are merely illustrations, and are not intended to limit the scope of the present invention to those components unless otherwise specifically described.

Example 1

<General Configuration and Image Forming Processing>

Figure 1:
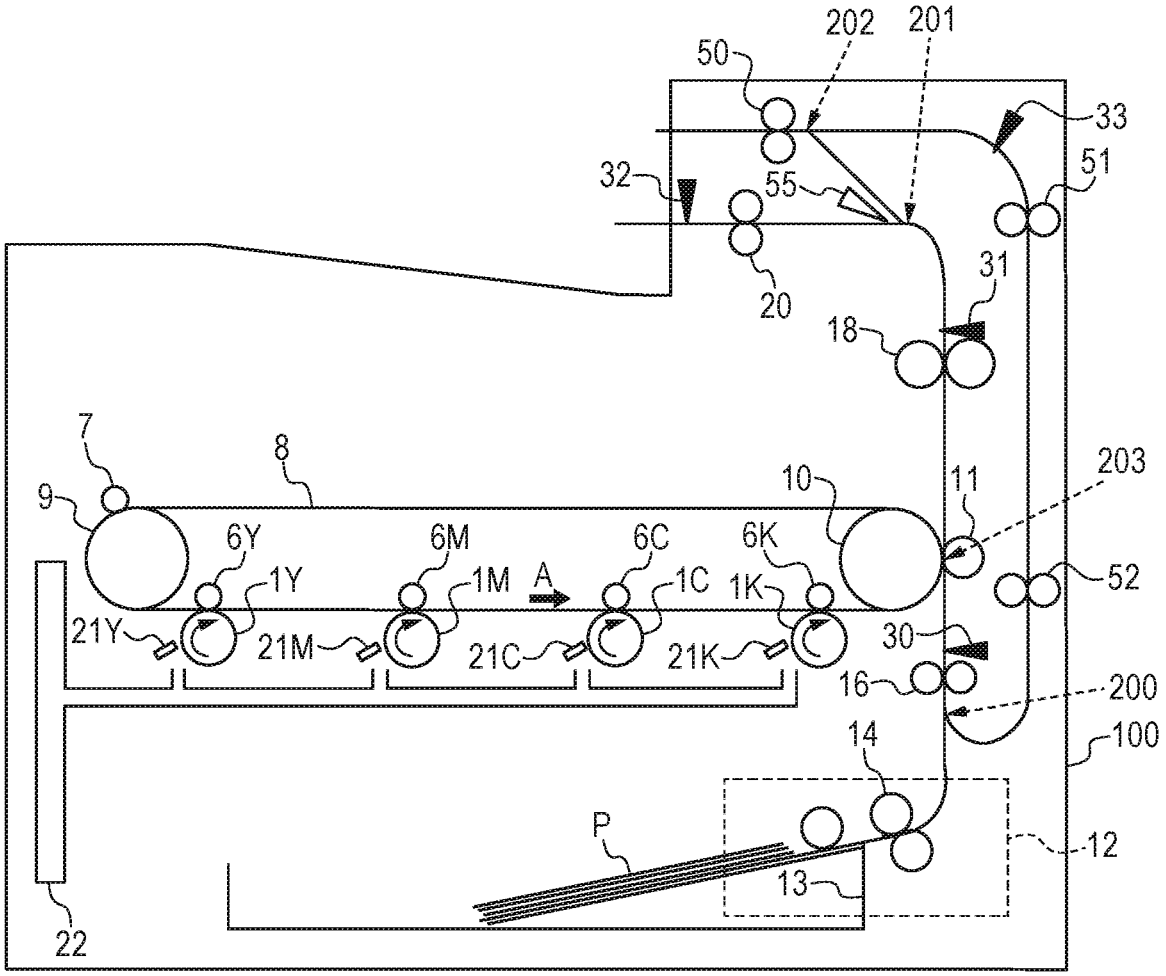
FIG. 1 is a cross-sectional view of an image forming apparatus of Examples 1 to 3.

The outline of the general configuration of an image forming apparatus of the color electrophotography system is described with reference to FIG. 1. The image forming apparatus illustrated in Example 1 is a laser printer using an electrophotography image forming processing. The color image forming apparatus illustrated in FIG. 1 includes four imaging parts that can be attached to and removed from a printer 100. The four imaging parts have the same structures, but are different in that the imaging parts form images with toners (developers) of different colors, i.e., yellow (Y), magenta (M), cyan (C), and black (K). Note that, except for the case where a specific color is described, the numerals of YMCK are omitted hereinafter.

Each of the imaging parts is formed by a photoconductive drum 1, a cleaning blade 21 (a cleaning unit of the photoconductive drum), a charge roller (not shown), a developing roller (not shown), and an exposure apparatus (not shown). The photoconductive drums 1 are uniformly charged to a negative potential by the charge rollers in a rotation process. Electrostatic latent images corresponding to a target color image (Y, M, C and K component images) are formed on the photoconductive drums 1 by receiving image exposure by the exposure apparatus. The electrostatic latent images formed on the photoconductive drums 1 are developed as toner images formed by negative toners, by making the toners of the respective colors adhere on the photoconductive drums 1 via the developing rollers.

An intermediate transfer unit is formed by an intermediate transfer belt 8, which is an image bearing member, a drive roller 9, a secondary transfer opposing roller 10, and a conductive roller 7. Additionally, primary transfer rollers 6 are configured to be provided inside the intermediate transfer belt 8 so as to oppose the photoconductive drums 1, and a primary transfer voltage is applied to the primary transfer rollers 6. In a case where the drive roller 9 is rotated by a motor (not shown), the intermediate transfer belt 8 is rotated, and accordingly, the secondary transfer opposing roller 10 performs following rotation. In a case where the intermediate transfer belt 8 and each of the photoconductive drums 1 are rotated in the direction of an arrow A, and a positive primary transfer voltage is applied to the primary transfer roller 6, the toner images on the photoconductive drums 1 are sequentially transferred onto the intermediate transfer belt 8 (on the image bearing member) (a primary transfer). Then, the toner images of the respective colors are borne by the intermediate transfer belt 8 in the state where the toner images are overlapped, and are conveyed to the position of a secondary transfer roller 11. The toner images are transferred to a sheet P, which is a recording medium, in a nip portion 203, which is a transfer position, with the positive voltage applied to the secondary transfer roller 11, which is a transfer unit. The toner images (hereinafter referred to as the remaining toners) that were not transferred to the sheet P are conveyed to the position of the conductive roller 7 by rotation of the intermediate transfer belt 8. The polarity of the remaining toners is reversed by the conductive roller 7, and the remaining toners are charged to the positive polarity. The remaining toners charged to the positive polarity are conveyed to the primary transfer rollers 6 by rotation of the intermediate transfer belt 8, and are transferred to the photoconductive drums 1 charged to the negative polarity, by the primary transfer rollers 6 to which the positive voltage is applied. The remaining toners transferred to the photoconductive drums 1 are collected in a waste toner container 22 by the cleaning blades 21.

A feeding/conveyance apparatus 12 feeds one sheet P at a time from inside of a sheet feeding cassette 13 storing sheets P. The fed sheet P is conveyed to a registration roller pair 16 by a feeding roller pair 14, and is subsequently conveyed to the secondary transfer roller 11 by the registration roller pair 16. A toner image is transferred to the sheet P conveyed by the secondary transfer roller 11 according to the above-described procedure. The sheet P on which the toner image has been transferred is conveyed to a fixing device 18. The sheet P conveyed to the fixing device 18 is heated and pressurized by the fixing device 18 so that the toner image is fixed to the sheet P, and is discharged to the outside of the printer 100 (outside of the apparatus) as an image formed object (such as a printed sheet) through a discharge roller pair 20.

In a case where the sheet P that passed the fixing device 18 is not to be discharged to the outside of the apparatus, and printing is to be performed on a second page that is different from a first page on which the image formation of the sheet P is completed, the sheet P that passed the fixing device 18 is conveyed to the direction of a reverse point 202. A double-side flapper 55 can switch the conveyance direction of the sheet P between a discharge direction and a reverse part direction. In a case where performing a double-sided printing, the double-side flapper 55 is switched to the reverse part direction before a tip of the sheet P on which the image formation on the first page is ended reaches a branching point 201. After the sheet P passes the reverse point 202, the sheet P is conveyed to a discharge direction outside the apparatus by a reverse roller pair 50. In a case where a trailing edge of the sheet P reaches between the reverse point 202 and the reverse roller pair 50, the rotation of the reverse roller pair 50 is stopped, and the sheet P is stopped at this position. Thereafter, in a case where the reverse roller pair 50 is rotated to the opposite direction, the sheet P is conveyed toward a double-side conveyance path. In the double-side conveyance path, the sheet P is conveyed by a double-side conveyance first roller pair 51 and a double-side conveyance second roller pair 52. The double-side conveyance path joins a conveyance path between the feeding/conveyance apparatus 12 and the registration roller pair 16 at the position of a joining point 200. The sheet P, whose front and rear surfaces are reversed, is conveyed to the secondary transfer roller 11 by the registration roller pair 16. Thereafter, similar to the first page, a toner image is transferred and fixed to the sheet P. By switching the double-side flapper 55 to the discharge direction outside the apparatus, the sheet P having images formed on both surfaces is discharged to the outside of the apparatus.

Note that, in Example 1, the registration roller pair 16, the secondary transfer opposing roller 10, the secondary transfer roller 11, the fixing device 18, the reverse roller pair 50, the double-side conveyance first roller pair 51, the double-side conveyance second roller pair 52, and the discharge roller pair 20 function as a conveyance unit. The registration roller pair 16, the secondary transfer opposing roller 10, the secondary transfer roller 11, the fixing device 18, the reverse roller pair 50, the double-side conveyance first roller pair 51, the double-side conveyance second roller pair 52, and the discharge roller pair 20 may have respective different motors serving as driving sources. Additionally, the driving sources for these pairs of rollers may be the same. In this case, each pair of rollers can be independently driven by providing a communication unit (for example, a clutch) that switches whether or not to communicate a driving force from the driving source to each pair of rollers.

Each of a registration sensor 30, a fixing unit discharge sensor 31, a discharge sensor 32, and a double-side reverse sensor 33 is provided on the conveyance path, detects whether or not the sheet P exists on the conveyance path, and functions as a detection unit. The registration sensor 30 is an example of the detection unit located in the upstream of the nip portion 203. The detection unit also includes a detection unit located in the upstream of the nip portion 203 as described above. Note that the detection unit located in the upstream of the nip portion 203 is not limited to the registration sensor 30. The printer 100 determines the sheet jam of the sheet P based on the driving timing of each actuator, the conveyance speed of the sheet P, the distance between each of the sensors, the length of the sheet P, and the change timing of detection of whether or not the sheet P exists by each of the sensors 30 to 33.

<Hardware Configuration Diagram>

Figure 2A:
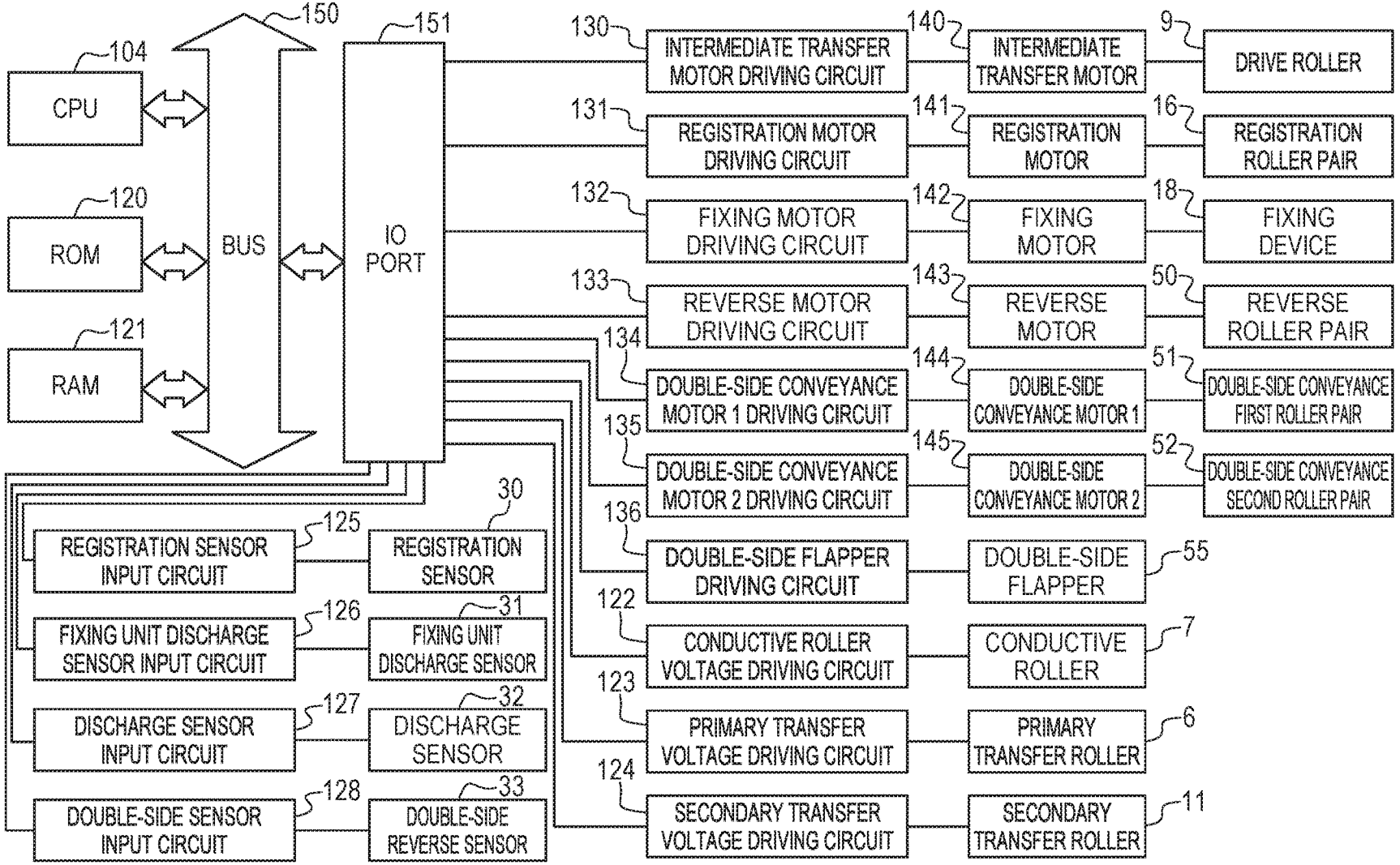
FIG. 2A is a hardware configuration diagram of the image forming apparatus of Examples 1 to 3.

FIG. 2A is a diagram illustrating a hardware configuration of Example 1. A CPU 104 communicates with a ROM 120, a RAM 121, and an I/O port 151 via a bus 150 for communication. The CPU 104 executes a program stored in the ROM 120, saves an operation result at the time of execution in the RAM 121, and obtains the saved operation result. Further, the CPU 104 monitors an input result of each sensor input circuit, which will be described later, via the I/O port 151 pursuant to the program stored in the ROM 120, and operates each driving circuit in the printer 100 according to the monitored result. In this manner, the CPU 104 controls the printer 100.

A registration sensor input circuit 125 converts the result of whether or not the sheet P is detected by the registration sensor 30 into a signal of 0 or 1. A fixing unit discharge sensor input circuit 126 converts the result of whether or not the sheet P is detected by the fixing unit discharge sensor 31 into a signal of 0 or 1. A discharge sensor input circuit 127 converts the result of whether or not the sheet P is detected by the discharge sensor 32 into a signal of 0 or 1. A double-side sensor input circuit 128 converts the result of whether or not the sheet P is detected by the double-side reverse sensor 33 into a signal of 0 or 1. The CPU 104 obtains the result of whether or not the sheet P is detected by each sensor via the I/O port 151 and each sensor input circuit.

The CPU 104 outputs a signal according to the voltage to be applied to the conductive roller 7 to a conductive roller voltage driving circuit 122 via the I/O port 151. The conductive roller voltage driving circuit 122 generates the voltage to be applied to the conductive roller 7 according to the input signal. Similarly, as for the primary transfer roller 6 and the secondary transfer roller 11, the CPU 104 outputs the signals according to the voltages to be applied to the respective rollers to a primary transfer voltage driving circuit 123 and a secondary transfer voltage driving circuit 124 via the I/O port 151. The primary transfer voltage driving circuit 123 and the secondary transfer voltage driving circuit 124 generate the voltages to be applied to the primary transfer roller 6 and the secondary transfer roller 11 according to the input signals, respectively.

In order to rotate the drive roller 9, the CPU 104 outputs the signal according to the rotating speed of the drive roller 9 to an intermediate transfer motor driving circuit 130 via the I/O port 151. The intermediate transfer motor driving circuit 130 drives an intermediate transfer motor 140 according to the input signal. The drive roller 9 is rotated in a case where the intermediate transfer motor 140 is driven. Similarly, in order to rotate the registration roller pair 16, the CPU 104 outputs the signal according to the rotating speed to a registration motor driving circuit 131 via the I/O port 151. In order to rotate the fixing device 18, the CPU 104 outputs the signal according to the rotating speed to a fixing motor driving circuit 132 via the I/O port 151. In order to rotate the reverse roller pair 50, the CPU 104 outputs the signal according to the rotating speed to a reverse motor driving circuit 133 via the I/O port 151. In order to rotate the double-side conveyance first roller pair 51 and the double-side conveyance second roller pair 52, the CPU 104 outputs the signals according to the respective rotating speeds to a double-side conveyance motor 1 driving circuit 134 and a double-side conveyance motor 2 driving circuit 135 via the I/O port 151. The registration motor driving circuit 131, the fixing motor driving circuit 132, and the reverse motor driving circuit 133 drive a registration motor 141, a fixing motor 142, and a reverse motor 143 according to the input signals, respectively. The double-side conveyance motor 1 driving circuit 134 and the double-side conveyance motor 2 driving circuit 135 drive a double-side conveyance motor 1 144 and a double-side conveyance motor 2 145 according to the input signals, respectively. The registration roller pair 16, the fixing device 18, the reverse roller pair 50, the double-side conveyance first roller pair 51, and the double-side conveyance second roller pair 52 are respectively rotated in a case where the above-described respective motors are driven. The CPU 104 outputs a switching signal for the double-side flapper 55 according to the conveyance direction of the sheet P to a double-side flapper driving circuit 136 via the I/O port 151. The double-side flapper driving circuit 136 switches the state of the double-side flapper 55 according to the input signal.

<Control Block Diagram>

Figure 2B:
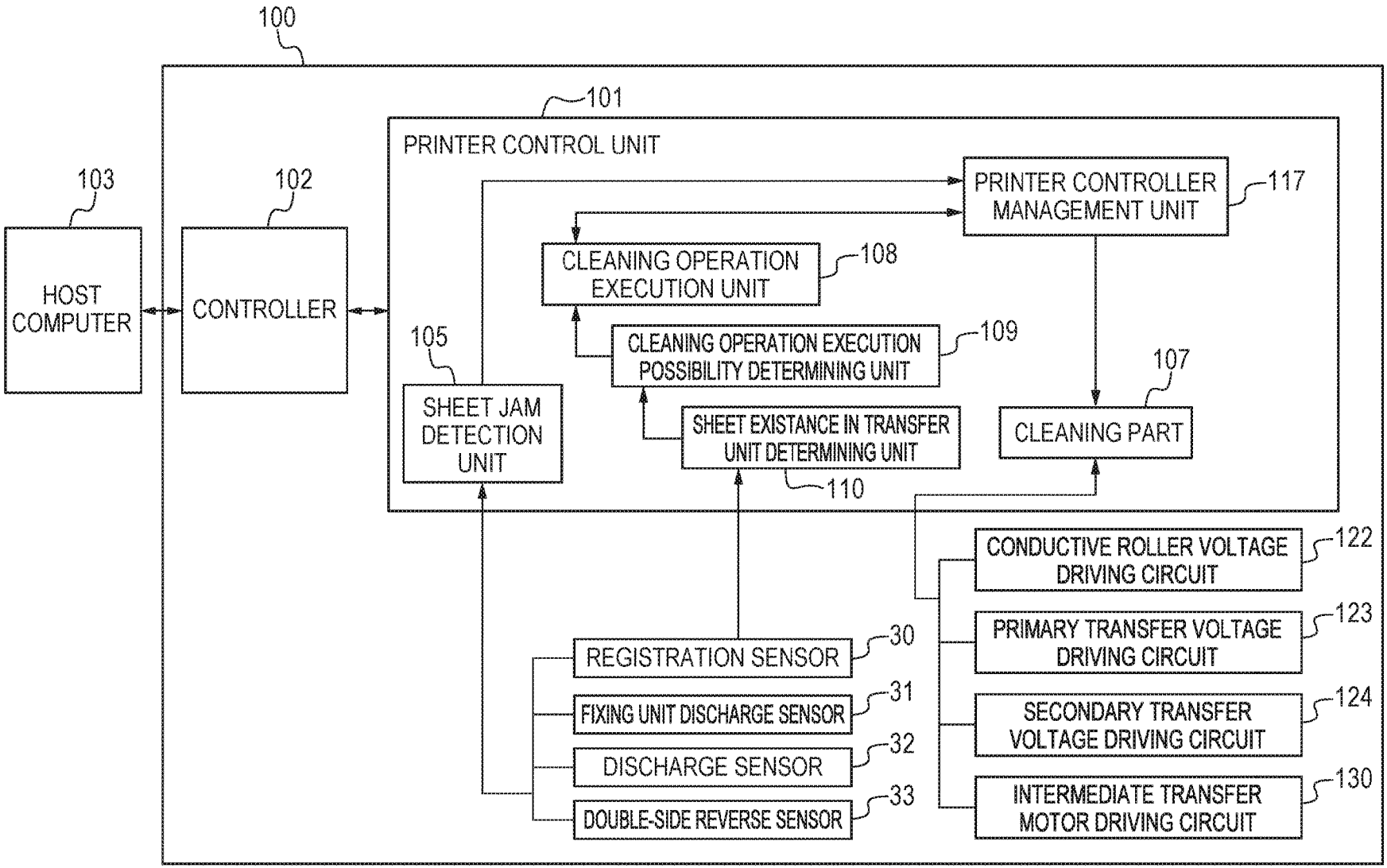
FIG. 2B is a control block diagram of Example 1.

FIG. 2B is a control block diagram of Example 1. A printer control unit 101, which is a control unit, includes a printer controller management unit 117, a sheet jam detection unit 105, a cleaning part 107, a cleaning operation execution unit 108, a cleaning operation execution possibility determining unit 109, and a sheet existence in transfer unit determining unit 110. The printer control unit 101 executes a program controlling each device in the printer 100. The sheet jam detection unit 105, which is a detection unit, detects that a sheet jam occurred based on the detection result of the existence/non-existence of the sheet P by each sensor, etc., and notifies the occurrence to the printer controller management unit 117. The sheet jam detection unit 105 also determines the kind of the sheet jam by a method described later. That is, the sheet jam detection unit 105 also functions as a determining unit. The cleaning part 107, which is a cleaning unit, performs a cleaning operation based on an execution instruction received from the printer controller management unit 117. After the cleaning operation execution unit 108 is notified that the sheet jam occurred from the printer controller management unit 117, at the time when the cleaning operation execution possibility determining unit 109 determines that the cleaning operation can be executed, the cleaning operation execution unit 108 instructs the execution of the cleaning operation to the printer controller management unit 117. In a case where the sheet existence in transfer unit determining unit 110 determines that there is no sheet P at the nip portion 203, the cleaning operation execution possibility determining unit 109 determines that the cleaning operation can be executed. The sheet existence in transfer unit determining unit 110 determines the existence/non-existence of the sheet P at the nip portion 203 based on the timing at which the registration sensor 30 detects the existence/non-existence of the sheet P, and the kind of the sheet jam occurred. Note that the kind of the sheet jam occurred is notified to the sheet existence in transfer unit determining unit 110 from the sheet jam detection unit 105 via the printer controller management unit 117. However, the sheet existence in transfer unit determining unit 110 may be configured to determine the kind of the sheet jam based on the detection result of each sensor, etc.

A controller 102 is connected to the printer control unit 101, and issues a print instruction and the like to the printer control unit 101 according to an instruction from a host computer 103, which is connected to the controller 102 via a network, a printer cable, etc. The controller 102 transmits image information received from the host computer 103 to the printer control unit 101 by synchronizing the image information with a synchronization signal transmitted from the printer control unit 101. Note that each of the functions of the printer control unit 101 may be realized by executing various kinds of control programs by the CPU 104, or a part or all of the functions may be performed by an application-specific dedicated circuit (not shown).

<Kinds of Sheet Jam>

The kinds of the sheet jam used in Example 1 are described below. First, a general delay-jam and a retention-jam are described.

Delay-Jam

First, a second detection unit for detecting the existence/non-existence of the sheet P is hereinafter referred to as the jam sensor. Additionally, a first detection unit provided in the upstream of the jam sensor in the conveyance direction of the sheet P is hereinafter referred to as the standard sensor. In a case where the detection result of the jam sensor is not changed from "no sheet exists" to "sheet exists" even if a predetermined time period passes (i.e., within the predetermined time period) after the detection result of the standard sensor is changed from "no sheet exists" to "sheet exists", this case is defined as the delay-jam. That is, the delay-jam is determined based on the results detected by the two sensors provided at different positions in the conveyance direction.

Retention-Jam

In a case where the detection result of the jam sensor is not changed from "sheet exists" to "no sheet exists" even if a predetermined time period passes (i.e., within the predetermined time period) after the detection result of the same jam sensor is changed from "no sheet exists" to "sheet exists", this case is considered as the retention-jam. That is, the retention-jam is determined based on the result detected by the one sensor.

In light of such circumstances, the kinds of the sheet jam in Example 1 are described below.

Feed Delay-Jam

The delay-jam that occurs in a case where the jam sensor is the registration sensor 30, and the standard sensor is the double-side reverse sensor 33 is considered to be a feed delay-jam. Additionally, in a case where the detection result of the registration sensor 30 is not changed from "no sheet exists" to "sheet exists" within a predetermined time period after feeding of the sheet P from the feeding/conveyance apparatus 12 is started, this case is also considered to be the feed delay-jam.

Feed Retention-Jam

The retention-jam that occurs in a case where the jam sensor is the registration sensor 30 is considered to be a feed retention-jam.

Fixing Unit Discharge Delay-Jam

The delay-jam that occurs in a case where the jam sensor is the fixing unit discharge sensor 31, and the standard sensor is the registration sensor 30 is considered as a fixing unit discharge delay-jam.

Fixing Unit Discharge Retention-Jam

The retention jam that occurs in a case where the jam sensor is the fixing unit discharge sensor 31 is considered as a fixing unit discharge retention-jam.

Discharge Delay-Jam

The delay jam that occurs in a case where the jam sensor is the discharge sensor 32, and the standard sensor is the fixing unit discharge sensor 31 when discharging the sheet P to the outside of the apparatus is considered as a discharge delay-jam.

Discharge Retention-Jam

The retention-jam that occurs in a case where the jam sensor is the discharge sensor 32 is considered as a discharge retention-jam.

Double-Side Reverse Delay-Jam

The delay-jam that occurs in a case where the jam sensor is the double-side reverse sensor 33, and the standard sensor is the fixing unit discharge sensor 31, when the sheet P is conveyed to the double-side conveyance path by using the reverse roller pair 50 in order to perform printing on the second page of the sheet P is considered as a double-side reverse delay-jam.

Double-Side Reverse Retention-Jam

The retention-jam that occurs in a case where the jam sensor is the double-side reverse sensor 33 is considered as a double-side reverse retention-jam.

Note that the "predetermined time period" described in the description of each of the jams is a value that is determined by the conveyance speed of the sheet P, the distance between the sensors that detect the existence/non-existence of sheet, the length of the sheet P, the detection error for determining a sheet jam, etc.

<Cleaning Operation>

The printer control unit 101 interrupts an image forming operation, in a case where the sheet jam detection unit 105 detects a sheet jam during the image forming operation and during conveyance of the sheet P. The printer control unit 101 stops driving of each motor via each motor driving circuit, and stops conveyance of the sheet P by each roller. In this case, a large amount of toner before being transferred to the sheet P by the secondary transfer roller 11 exists on the intermediate transfer belt 8. In order to prevent an image adverse effect due to the large amount of toner, the printer control unit 101 performs the cleaning operation by the cleaning part 107 before resuming the image forming operation (see FIG. 2B). More specifically, the printer control unit 101 rotates the intermediate transfer belt 8 and each of the photoconductive drums 1, and applies a voltage to the charge roller and the conductive roller 7. Additionally, the printer control unit 101 applies a negative voltage to the primary transfer roller 6. Along with these operations, the printer control unit 101 applies the voltage having the polarity opposite to the polarity during the image forming operation to the secondary transfer roller 11, so as not to allow a toner before reversing the polarity adhere to the secondary transfer roller 11 by the conductive roller 7. By maintaining these operations for a predetermined time period, the toner on the photoconductive drums 1 and the toner on the intermediate transfer belt 8 are collected into the waste toner container 22 by the cleaning blade 21.

<Return Operation After Interrupting Image Forming Operation>

Figure 3A:
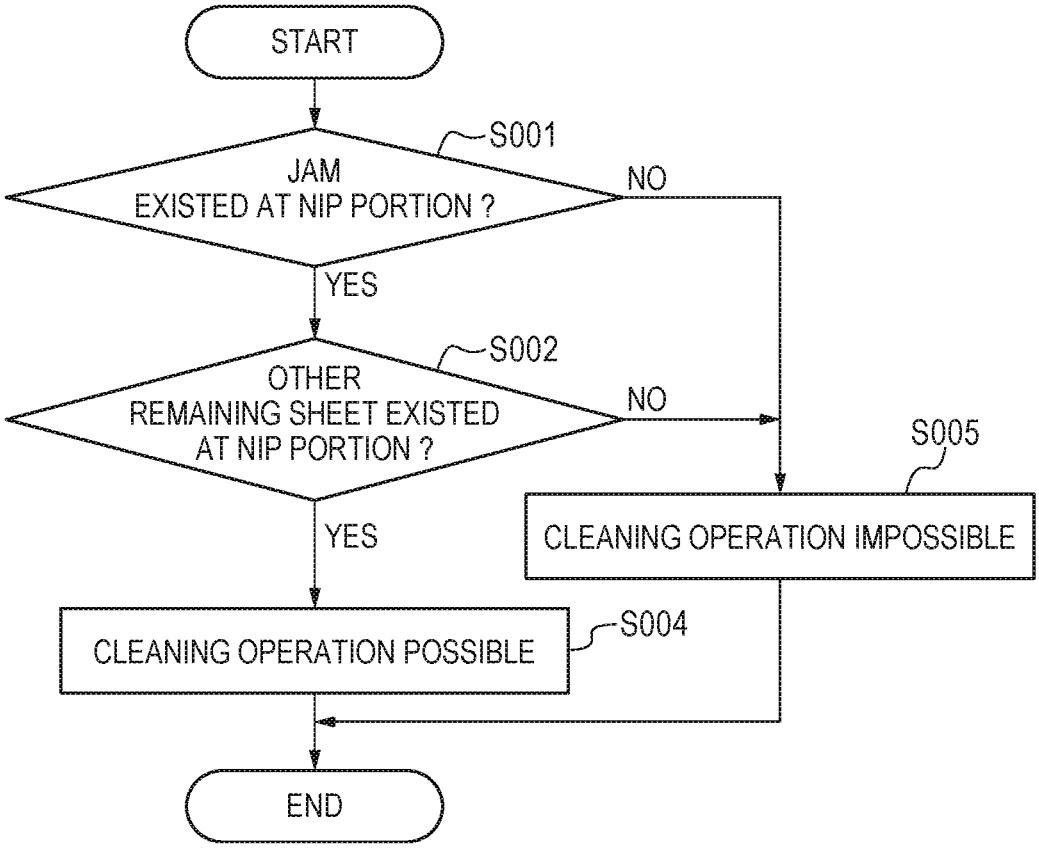
FIG. 3A and FIG. 3B are flowcharts illustrating a cleaning operation execution possibility determining processing of Example 1.
Figure 4:
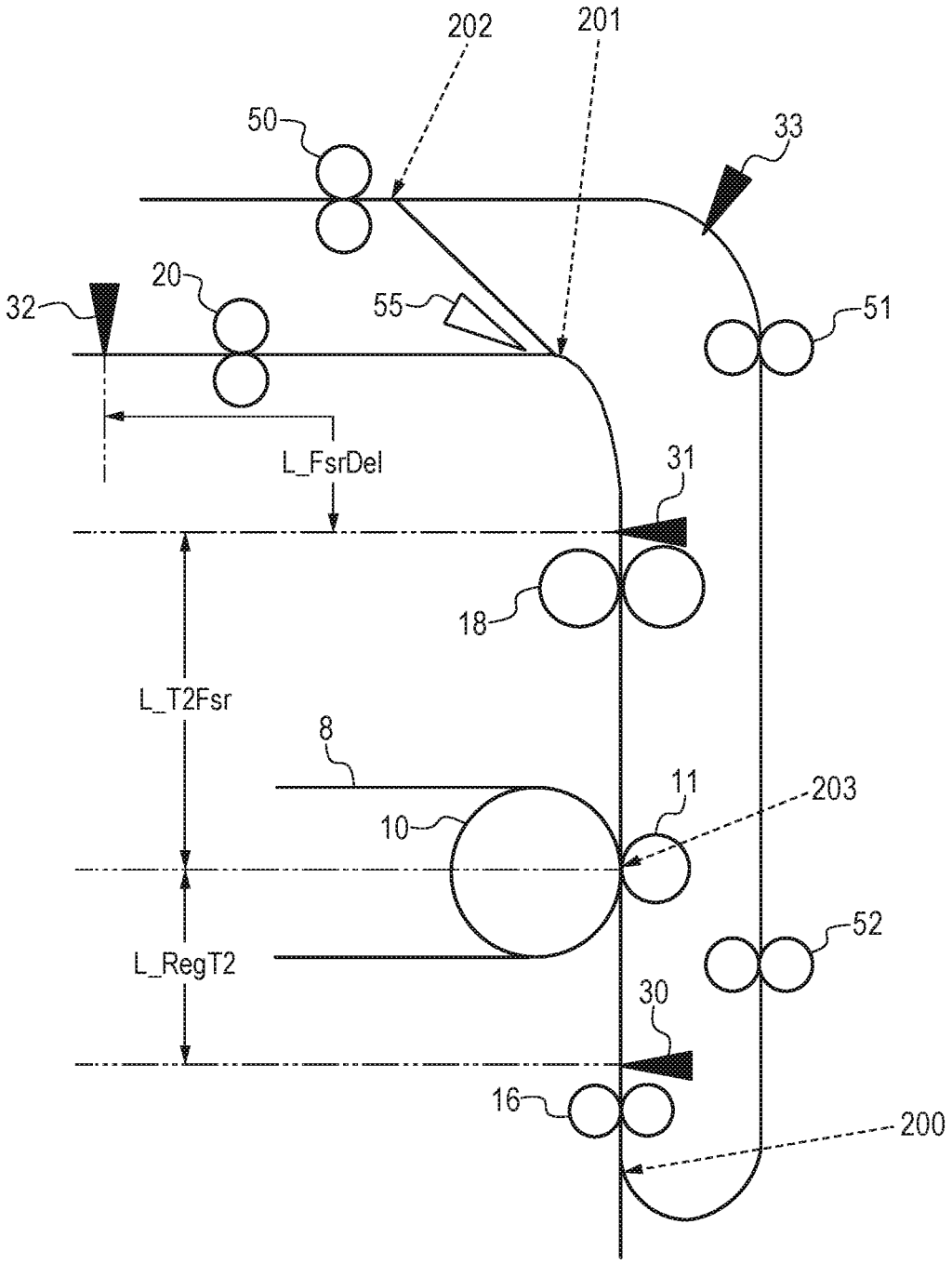
FIG. 4 is a diagram illustrating an important part of a conveyance path of Example 1.

The determination procedure of the cleaning operation execution possibility determining unit 109 at the time when a sheet jam occurs during an image forming operation in Example 1 is described using the flowchart in FIG. 3A and an enlarged view of the conveyance path in FIG. 4. First, the words and phrases in FIG. 4 are described. L_RegT2 is the distance on the conveyance path between the registration sensor 30 and the nip portion 203. L_T2Fsr is the distance on the conveyance path between the nip portion 203 and the fixing unit discharge sensor 31. L_FsrDel is the distance on the conveyance path between the fixing unit discharge sensor 31 and the discharge sensor 32.

Each of the distances and the conveyance speed of the sheet P in Example 1 are as follows.

L_RegT2: 30 mm (millimeter)

L_T2Fsr: 150 mm

L_FsrDel: 200 mm

The conveyance speed of the sheet P: 200 mm/s (millimeter per second)

(Existence/Non-Existence Determination Process of Sheet P by Nip Portion 203)

Next, a determination method of the existence/non-existence of sheet at the nip portion 203 based on the change timing of the detection result of the existence/non-existence of sheet by the registration sensor 30 during conveyance of the sheet P is described. The timing at which the nip portion 203 is changed from "no sheet exists" to "sheet exists" can be determined from L_RegT2 and the conveyance speed of the sheet P as follows. That is, the timing at which the nip portion 203 is changed from "no sheet exists" to "sheet exists" is after 150 ms (=L_RegT2/the conveyance speed of the sheet P) since the detection result of the existence/non-existence of sheet by the registration sensor 30 is changed from "no sheet exists" to "sheet exists". The timing at which the nip portion 203 is changed from "sheet exists" to "no sheet exists" can be similarly determined. Hereinafter, the determination method based on the detection result by the registration sensor 30 is referred to as the sheet existence/non-existence timing determination at the nip portion 203.

(Determination Process of Whether or Not Cleaning Operation can be Performed)

Lastly, the determination method of the cleaning operation execution possibility determining unit 109 is described by using FIG. 3A. In a case where the printer control unit 101 detects any sheet jam, the printer control unit 101 stops driving of a portion at which the sheet jam occurred, and performs determination by the cleaning operation execution possibility determining unit 109. In step S001, the cleaning operation execution possibility determining unit 109 determines whether or not there is any sheet P that caused the jam (a recording medium that caused the sheet jam) (hereinafter referred to as a jammed sheet) at the nip portion 203. Specifically, the cleaning operation execution possibility determining unit 109 determines whether or not there is any jammed sheet at the nip portion 203 based on the kind of the sheet jam and the length of the jammed sheet in the conveyance direction (hereinafter referred to as the sheet length) by the method described above. In a case where the cleaning operation execution possibility determining unit 109 determines that there is no jammed sheet at the nip portion 203, the processing proceeds to S002, and in a case where the cleaning operation execution possibility determining unit 109 determines that there is a jammed sheet at the nip portion 203, the processing proceeds to S005.

Here, for example, in a case where the kind of the sheet jam is a feed delay-jam, since it is before the tip of a jammed sheet reaches the registration sensor 30, the cleaning operation execution possibility determining unit 109 determines that the jammed sheet does not exist at the nip portion 203. In a case where the kind of the sheet jam is a feed retention-jam, since it is before the trailing edge of the sheet P passes the registration sensor 30, the cleaning operation execution possibility determining unit 109 determines that the jammed sheet exists at the nip portion 203. In a case where the kind of the sheet jam is a fixing unit discharge delay-jam, the sheet P cannot be normally conveyed between the registration sensor 30 and the fixing unit discharge sensor 31. Therefore, irrespective of the result of the sheet existence/non-existence timing determination at the nip portion 203 described above, the cleaning operation execution possibility determining unit 109 determines that the sheet P exists at the nip portion 203, since the position of the sheet P is indefinite.

In a case where the kind of the sheet jams is a fixing unit discharge retention-jam, based on L_T2Fsr and the sheet length of a jammed sheet, it is determined whether or not the jammed sheet exists at the nip portion 203. In a case where the kind of the sheet jam is a double-side reverse retention-jam, since it is after the trailing edge of a jammed sheet passes through the fixing unit discharge sensor 31, the cleaning operation execution possibility determining unit 109 determines that the jammed sheet does not exist at the nip portion 203, irrespective of the sheet length of the jammed sheet. In the case of a fixing unit discharge retention-jam, since at least the tip of the jammed sheet is located in the downstream of the fixing unit discharge sensor 31, in a case where the sheet length of the jammed sheet is shorter than L_T2Fsr, the cleaning operation execution possibility determining unit 109 determines that the jammed sheet does not exist at the nip portion 203. That is, in a case where the sheet length of the jammed sheet is less than 150 mm (=L_T2Fsr), it is determined that the jammed sheet does not exist.

As for the other kinds of jams, the cleaning operation execution possibility determining unit 109 similarly determines whether the processing should proceed to S002, or the processing should proceed to S005 based on the sheet length of the sheet P. For example, in the case of a discharge retention-jam, since the tip of a jammed sheet is in the discharge sensor 32, the cleaning operation execution possibility determining unit 109 determines whether the processing should proceed to S002, or the processing should proceed to S005, by comparing the sum of L_T2Fsr and L_FsrDel with the sheet length of the jammed sheet.

In S002, the cleaning operation execution possibility determining unit 109 determines whether or not a sheet P other than the jammed sheet remains in the printer 100. The sheet P other than the jammed sheet remaining in the printer (other recording medium) is hereinafter referred to as the remaining sheet. Here, the sheet P other than the jammed sheet is considered as being normally conveyed, and the cleaning operation execution possibility determining unit 109 determines whether or not the remaining sheet exists at the nip portion 203 by using the sheet existence/non-existence timing determination at the nip portion 203 described above. In S002, in a case where the cleaning operation execution possibility determining unit 109 determines that the remaining sheet does not exist at the nip portion 203, the processing proceeds to S004. In S004, the cleaning operation execution possibility determining unit 109 determines that the cleaning operation before a user removes the sheet P remaining in the printer 100 is possible, and the processing ends. Hereinafter, the operation of removing the sheet P remaining in the printer 100 by a user is referred to as the jam clear by the user. In S002, in a case where the cleaning operation execution possibility determining unit 109 determines that the remaining sheet exists at the nip portion 203, the processing proceeds to S005. In S005, the cleaning operation execution possibility determining unit 109 determines that the cleaning operation before the jam clear by the user is impossible, and the processing ends.

(Cleaning Operation Execution Process)

Figure 3B:
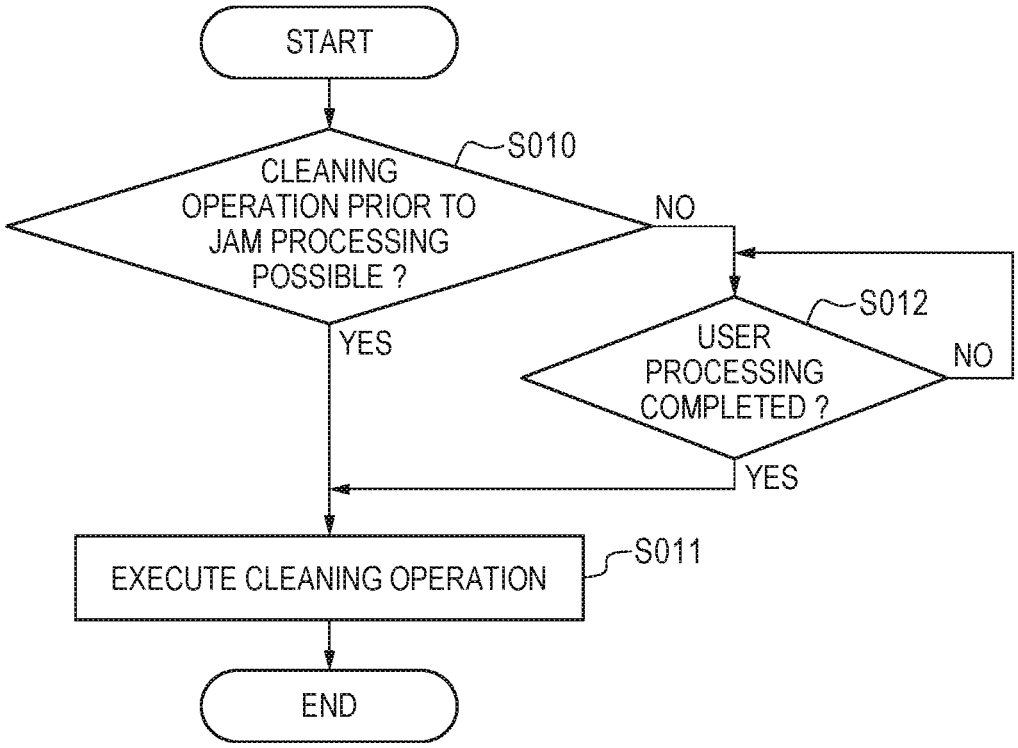

Next, the operation of the cleaning operation execution unit 108 is described by using the flowchart in FIG. 3B. The cleaning operation execution unit 108 switches whether or not to perform the cleaning operation before the jam clear by the user, based on the determination result by the cleaning operation execution possibility determining unit 109. In S010, the cleaning operation execution unit 108 determines whether or not the cleaning operation execution possibility determining unit 109 determined in S004 of FIG. 3A that the cleaning operation before the jam clear by the user (before a jam processing) is possible. In S010, in a case where the cleaning operation execution possibility determining unit 109 determines that the cleaning operation before the jam clear is possible, the processing proceeds to S011. In S010, in a case where the cleaning operation execution possibility determining unit 109 determines that the cleaning operation before the jam clear is impossible, the processing proceeds to S012.

In S012, the cleaning operation execution unit 108 determines whether or not the jam clear by the user (a user processing) is completed. Specifically, the cleaning operation execution unit 108 determines whether or not the jam clear is completed based on whether or not the cleaning operation execution unit 108 is informed of the completion of the jam clear by the user from the printer controller management unit 117. In S012, in a case where the cleaning operation execution unit 108 determines that the cleaning operation execution unit 108 is informed of the completion of the user's jam clear from the printer controller management unit 117, the processing proceeds to S011. In S012, in a case where the cleaning operation execution unit 108 determines that the cleaning operation execution unit 108 is not informed of the completion of the jam clear by the user, the processing returns to S012. In S011, the cleaning operation execution unit 108 informs the printer controller management unit 117 of a start request of the cleaning operation, and the processing ends. The printer controller management unit 117 instructs the cleaning operation to the cleaning part 107. The printer controller management unit 117 determines that the image forming operation by the printer 100 can be resumed, in response to the completion of both the cleaning operation requested by the cleaning operation execution unit 108, and the jam clear by the user As described above, in a case where the sheet P does not exist at the nip portion 203 when a sheet jam occurs, the printer control unit 101 performs the cleaning operation without waiting for the jam clear by the user. In this case, since a required cleaning operation has already been conducted, the cleaning operation is not performed after the jam clear by the user. Therefore, the time until an image forming operation is resumed after the user notices a sheet jam, and the jam clear by the user is performed is reduced. Note that, in Example 1, the sheet existence/non-existence at the nip portion 203 is determined based on the time that has passed since the change timing of the sheet existence/non-existence of the registration sensor 30. Example 1 is not limited to this configuration, and the printer control unit 101 may adjust the timing for switching the determination result of the sheet existence/non-existence at the nip portion 203, while also considering the control variation in the conveyance speed of each roller.

Additionally, in Example 1, the sheet existence/non-existence at the nip portion 203 is determined assuming that each sheet length is known. Example 1 is not limited to this configuration, and the sheet length may be determined from the time period during which each sensor continues to detect "sheet exists" and the conveyance speed of the sheet P. Additionally, the sheet existence/non-existence at the nip portion 203 may be configured to be determined based on the time difference between the timing at which the registration sensor 30 detects "no sheet exists" and the timing at which a sheet jam is detected, and based on the conveyance speed of the sheet P.

As described above, according to Example 1, it is possible to reduce the waiting time for the user until an image forming operation can be resumed after the image forming operation is interrupted.

Example 2

In Example 1, the control has been illustrated that switches whether or not to perform the cleaning operation before the jam clear by the user, according to the existence/non-existence of the sheet P at the nip portion 203 at the time of occurrence of a sheet jam. Here, even in the state where a remaining sheet exists at the nip portion 203, there are cases where the sheet P can be removed from the nip portion 203 by driving roller pairs other than the roller pair holding the jammed sheet. In Example 2, a control method is illustrated that performs the cleaning operation before the jam clear by the user, by removing the remaining sheet from the nip portion 203, in a case where the remaining sheet exists at the nip portion 203 when a sheet jam occurs. Note that, since <General Configuration and Image Forming Processing>, <Kinds of Sheet Jam>, and <Cleaning Operation> are the same as those in Example 1, a description thereof will be omitted.

<Control Block Diagram>

Figure 5:
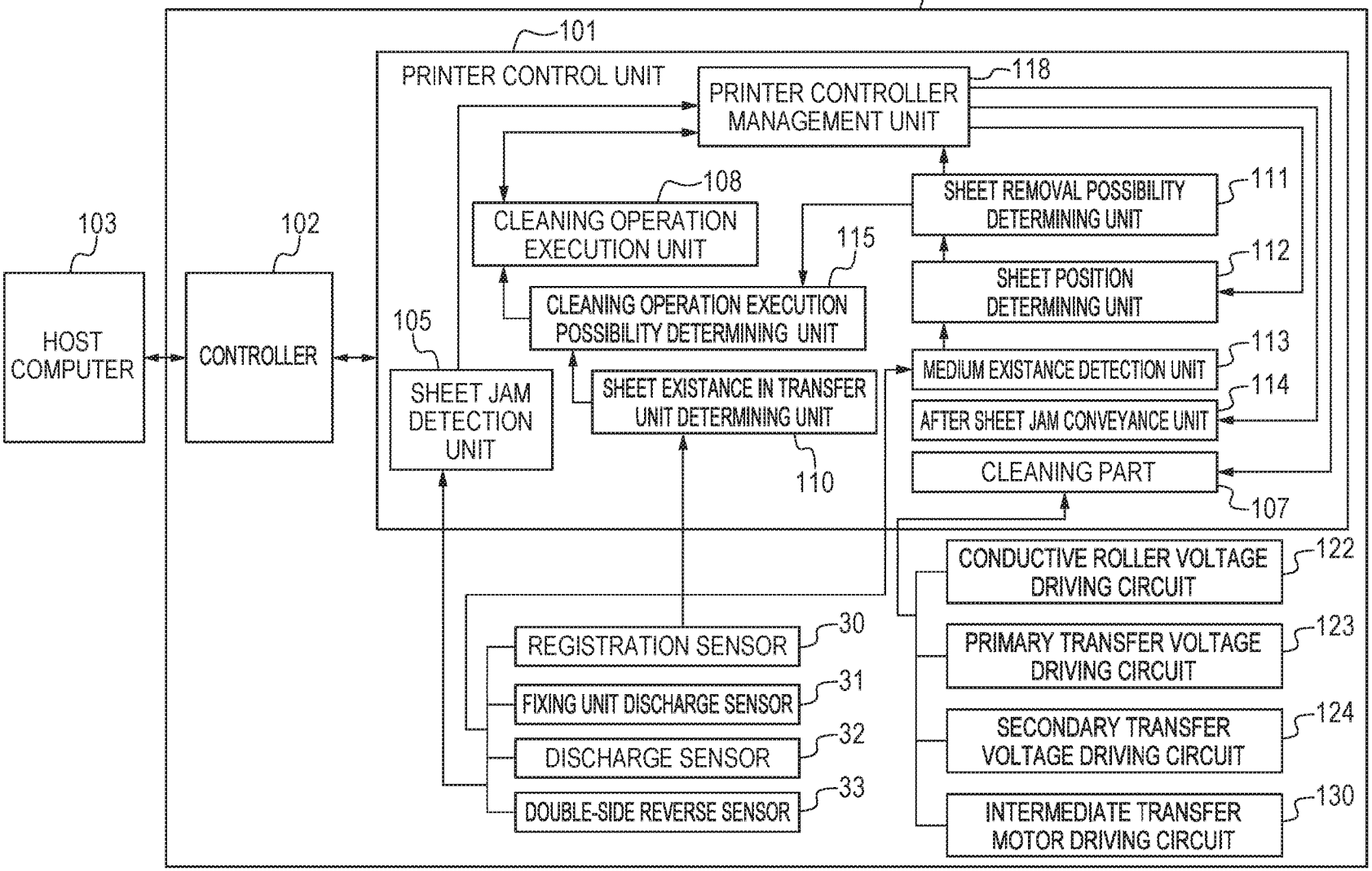
FIG. 5 is a control block diagram of the image forming apparatus of Example 2.

FIG. 5 is a control block diagram of Example 2. As for the same components as those in Example 1, the same numbers are used, and a description thereof will be omitted. In Example 2, the printer control unit 101 further includes a sheet removal possibility determining unit 111, a sheet position determining unit 112, a medium existence detection unit 113, and an after sheet jam conveyance unit 114. The cleaning operation execution possibility determining unit 115 determines whether or not the cleaning operation can be performed, based on the determination results of the sheet existence in transfer unit determining unit 110 and the sheet removal possibility determining unit 111. The sheet removal possibility determining unit 111 performs the following determinations based on the information on the position of the sheet P inside the printer 100 by the sheet position determining unit 112. That is, it is determined whether or not a remaining sheet can be conveyed without colliding with the jammed sheet, and the sheet P can be removed from the nip portion 203, in a case where the remaining sheet inside the printer 100 other than a jammed sheet is conveyed without driving the driving units in which the jammed sheet is located. The sheet position determining unit 112 determines the position of each sheet P inside the printer 100 based on the detection result of the sheet existence/non-existence of each sensor by the medium existence detection unit 113, and based on the kind of sheet jam and the sheet length of each sheet P, which are obtained from the printer controller management unit 118.

<Return Operation After Interrupting Image Forming Operation>

Figure 6:
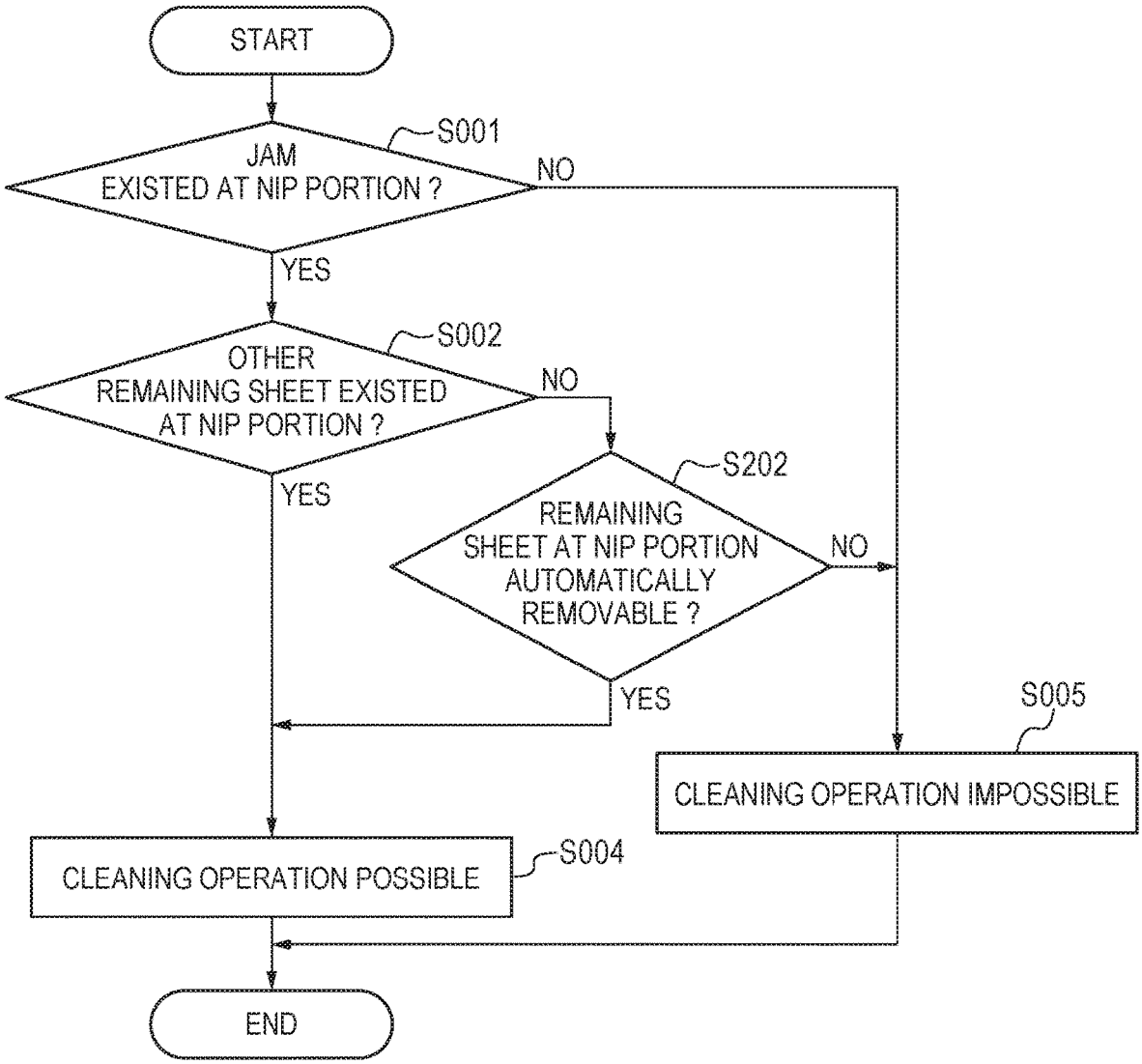
FIG. 6 is a flowchart illustrating the cleaning operation execution possibility determining processing of Example 2.

Using FIG. 6, a detailed description will be given of the determination procedure by the cleaning operation execution possibility determining unit 115 at the time when a sheet jam occurs during an image forming operation in Example 2. As for the same steps as those in FIG. 3A or the steps that are different from those in FIG. 3A only in the transition destinations for determination processing, the same numbers are used, and a description thereof will be omitted. Note that, in Example 2, a description will be given below by assuming that a feed delay jam occurs, and the sheet P fed prior to the jammed sheet exists at the nip portion 203.

In S002, the same determination as that in Example 1 is performed, and in a case where the cleaning operation execution possibility determining unit 115 determines that a remaining sheet other than a jammed sheet exists at the nip portion 203, the processing proceeds to S202. In S202, the cleaning operation execution possibility determining unit 115 determines whether or not a remaining sheet at the nip portion 203 can be automatically removed by conveying the remaining sheet. Specifically, the cleaning operation execution possibility determining unit 115 obtains the determination result by the sheet removal possibility determining unit 111, and performs the determination in S202 based on this determination result. In a case where the sheet removal possibility determining unit 111 determines that the remaining sheet at the nip portion 203 can be automatically removed from nip portion 203, in S202, the cleaning operation execution possibility determining unit 115 advances the processing to S004. In a case where the sheet removal possibility determining unit 111 determines that the remaining sheet at the nip portion 203 cannot be automatically removed from the nip portion 203, in S202, the cleaning operation execution possibility determining unit 115 advances the processing to S005. Since the operation of the cleaning operation execution unit 108 is the same as that in FIG. 3B of Example 1, a description thereof will be omitted.

(Sheet Removal Possibility Determination Processing)

The sheet removal possibility determining unit 111 determines whether or not the sheet P at the nip portion 203 can be removed, based on position information on each sheet P inside the printer 100 obtained from the sheet position determining unit 112. For example, in a case where a sheet jam occurred is a feed delay-jam, the sheet position determining unit 112 determines that a jammed sheet is in the upstream of the nip portion 203, and informs the sheet removal possibility determining unit 111 of the determination result. The sheet removal possibility determining unit 111 has obtained the information that the jammed sheet is in the upstream of the nip portion 203 from the sheet position determining unit 112. Therefore, the sheet removal possibility determining unit 111 determines that the driving units in the downstream of the nip portion 203 can be driven, determines that the sheet P can be removed from the nip portion 203, and informs the printer controller management unit 118 of the determinations.

Since the printer controller management unit 118 is informed that the remaining sheet at the nip portion 203 can be removed from the sheet removal possibility determining unit 111, the printer controller management unit 118 instructs the after sheet jam conveyance unit 114 to perform a conveying operation in the printer 100, including the removal operation of the remaining sheet at the nip portion 203. Specifically, the printer controller management unit 118 instructs the after sheet jam conveyance unit 114 to perform an operation equivalent to the usual conveying operation on each roller located in the downstream of the nip portion 203. However, in a case where the conveying operation for performing image formation on the second page of the sheet P is continued, the sheet P will collide with a jammed sheet in the vicinity of the joining point 200. Therefore, the printer controller management unit 118 instructs the after sheet jam conveyance unit 114 to stop conveyance of the sheet P that exists in the double-side conveyance path. For the same reason, in a case where the tip of the remaining sheet is in the downstream of the branching point 201, the printer controller management unit 118 gives instructions as follows with respect to the sheet P that is before being drawn to the double-side conveyance path. That is, the printer controller management unit 118 instructs the after sheet jam conveyance unit 114 to stop conveyance of the remaining sheet, so that the trailing edge of the remaining sheet is located between the reverse point 202 and the reverse roller pair 50.

Here, in a case where removing the remaining sheet at the nip portion 203, the after sheet jam conveyance unit 114 rotates the intermediate transfer belt 8 by driving not only each roller located in the downstream of the nip portion 203, but also the drive roller 9. On this occasion, the toner remaining on the intermediate transfer belt 8 is transferred to the remaining sheet, and thereafter fixed to the remaining sheet by the fixing device 18. Further, the voltage having the polarity opposite to the polarity during the image forming operation may be applied to the secondary transfer roller 11, so that it is controlled the toner remaining on the intermediate transfer belt 8 is not transferred to the remaining sheet.

As described above, the printer control unit 101 performs the cleaning operation in the state where the remaining sheet does not remain at the nip portion 203 by removing the remaining sheet at the nip portion 203. Therefore, it is possible to prevent sliding abrasion by rotating the intermediate transfer belt 8 in the state where the remaining sheet is sandwiched by the nip portion 203 and other roller pairs. Additionally, it is possible to prevent deterioration, etc. of the removal property of the remaining sheet caused by jamming of the remaining sheet toward the roller located on the downstream side by rotating the intermediate transfer belt 8 in the state where the remaining sheet is sandwiched at the nip portion 203. Further, the cleaning operation can be performed while preventing these problems. Additionally, in a case where a sheet jam occurred is a feed delay-jam, the printer control unit 101 performs the cleaning operation before the jam clear by the user. In this case, since a required cleaning operation has already been conducted, further cleaning operation is not performed after the jam clear by the user. Thus, the time until an image forming operation is resumed after the user notices a sheet jam, and the jam clear by the user is performed is reduced.

Note that, in Example 2, the printer controller management unit 118 instructed the after sheet jam conveyance unit 114 to perform a conveying operation equivalent to the usual conveying operation. Therefore, the after sheet jam conveyance unit 114 discharges the remaining sheet, including the remaining sheet at the nip portion 203, to the outside of the apparatus, or conveys the remaining sheet to the vicinity of the reverse roller pair 50. However, since the cleaning operation can be performed in a case where the remaining sheet does not exist at the nip portion 203, the after sheet jam conveyance unit 114 may be configured to stop sheet conveyance at the time when the remaining sheet does not exist at the nip portion 203.

As described above, according to Example 2, it is possible to reduce the waiting time for the user until an image forming operation can be resumed after the image forming operation is interrupted.

Example 3

In Example 2, the configuration has been illustrated in which the printer controller management unit 118 starts the cleaning operation at the time when the sheet removal possibility determining unit 111 determines that the removal of the remaining sheet from the nip portion 203 is possible. In a case where a new sheet jam occurs before the remaining sheet at the nip portion 203 is removed after starting the cleaning operation, the cleaning operation may be interrupted. Therefore, the driving sound and stop sound (hereinafter referred to as the operation sound) of each actuator may be excessively generated. In Example 3, a control method is illustrated that performs the cleaning operation before the jam clear by the user, while suppressing such operation sound by starting the cleaning operation after the sheet is removed from the nip portion 203. Since <General Configuration and Image Forming Processing>, <Kinds of Sheet Jam>, and <Cleaning Operation> are the same as those in Example 1, a description thereof will be omitted <Control Block Diagram>

Figure 7:
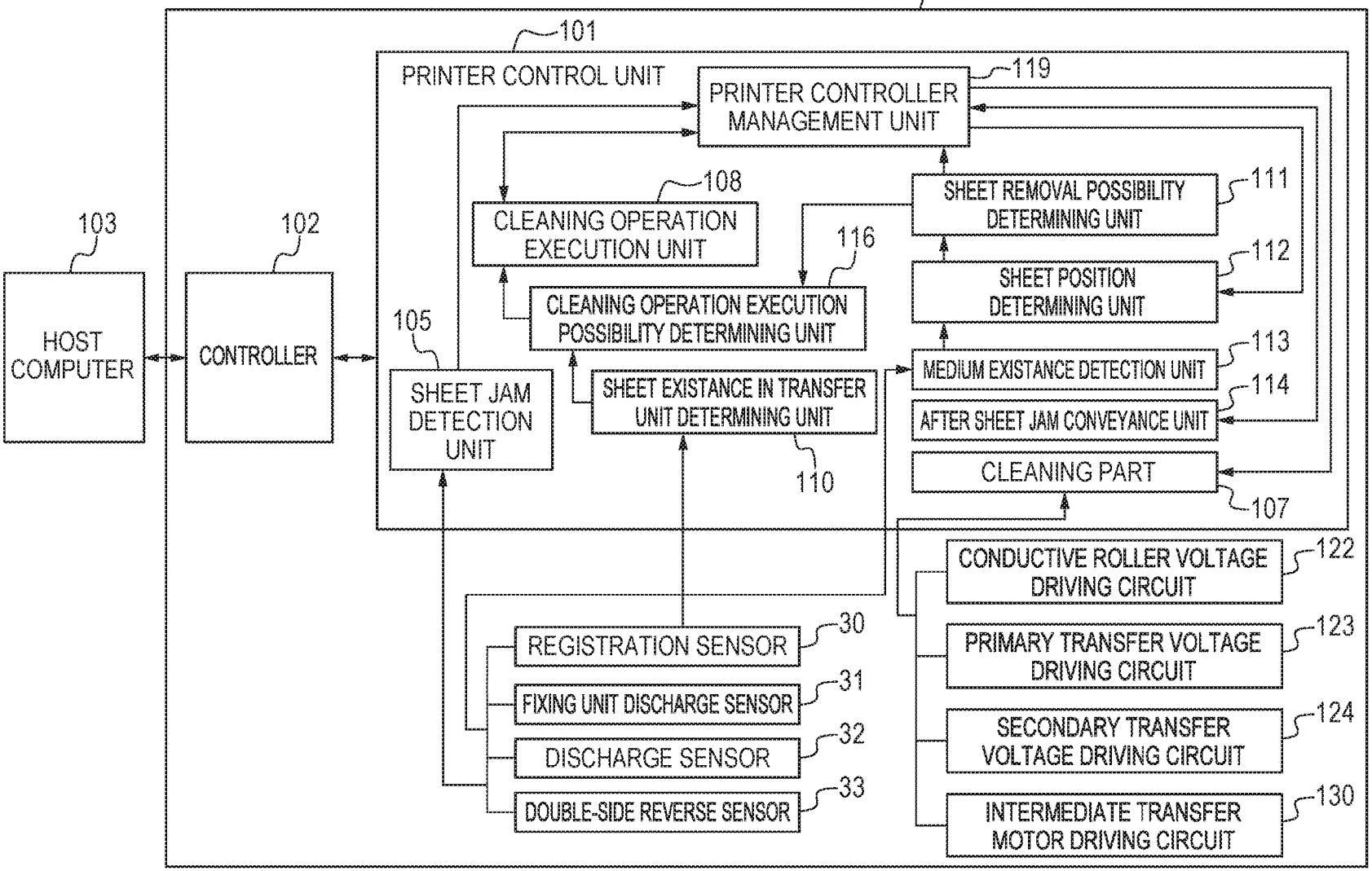
FIG. 7 is a control block diagram of the image forming apparatus of Example 3.

FIG. 7 is a control block diagram of Example 3. As for the same components as those in Examples 1 and 2, the same numbers are used, and a description thereof will be omitted. The cleaning operation execution possibility determining unit 116 is informed from the printer controller management unit 119 that conveyance of the remaining sheet is completed by the after sheet jam conveyance unit 114. The cleaning operation execution possibility determining unit 116 determines that the cleaning operation is possible, in a case where the completion of conveyance of the remaining sheet is informed from the printer controller management unit 119.

<Return Operation After Interrupting Image Forming Operation>

Figure 8:
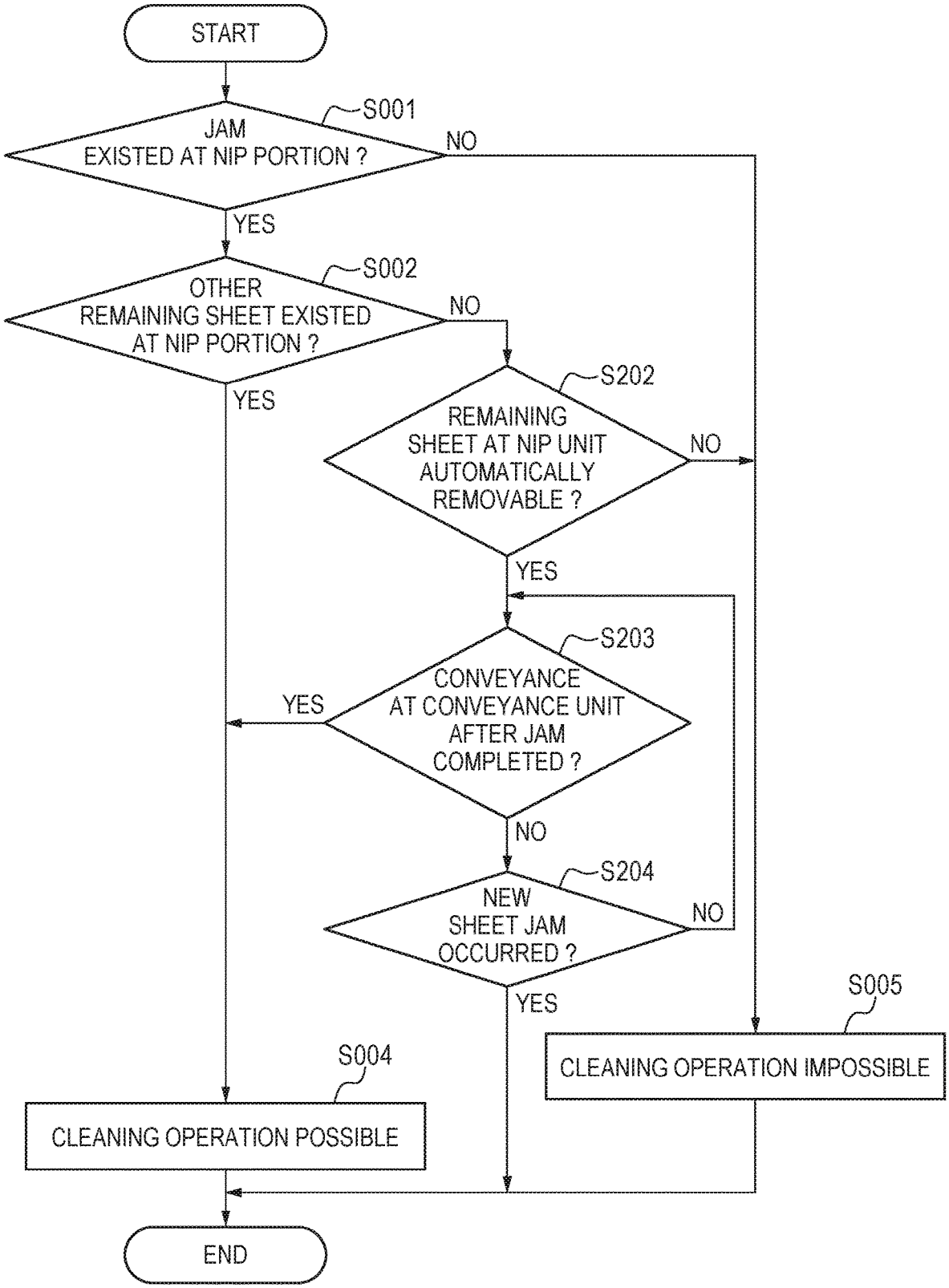
FIG. 8 is a flowchart illustrating the cleaning operation execution possibility determining processing of Example 3.

A detailed description will be given of the determination procedure by the cleaning operation execution possibility determining unit 116 at the time when a sheet jam occurs during the image forming operation, by using the flowchart in FIG. 8, and the diagrams in FIG. 9A to FIG. 12B illustrating the position of each sheet P inside the printer 100. Regarding the flowchart in FIG. 8, as for the steps in which the same processing as that in FIG. 6 is performed or the steps that are different from those in FIG. 6 only in the transition destinations for determination processing, the same numbers are used, and a description thereof will be omitted.

Here, the detailed contents of the determination by the sheet removal possibility determining unit 111 that "the remaining sheet can be removed from the nip portion 203" are different depending on a sheet jam occurred, and the position of the remaining sheet at the time of the occurrence of the sheet jam. Similarly, the details of the conveyance method of the after sheet jam conveyance unit 114 are also different. Thus, in Example 3, five patterns (Cases 1 to 5) are described for the same functional blocks and the same flowchart. The five patterns are different in the sheet jam that occurs, the detailed position of each sheet P inside the printer 100 at the time of the occurrence of the sheet jam, and the detailed method of removing the remaining sheet. Note that, as for the values such as the distance and the conveyance speed, the values used in Examples 1 and 2 are used unless otherwise described.

<Case 1>

A description will be given below of the control in a case where a feed delay-jam occurs, and the sheet P fed prior to a jammed sheet remains at the nip portion 203 as the remaining sheet. In S202 of FIG. 8, in a case where the cleaning operation execution possibility determining unit 116 determines that the remaining sheet can be automatically removed based on the result obtained from the sheet removal possibility determining unit 111, the processing proceeds to S203. Since the sheet removal possibility determining unit 111 determines that the remaining sheet can be removed at the timing of the determination in S202, the printer controller management unit 119 instructs the after sheet jam conveyance unit 114 to perform the conveying operation of the printer 100, including the removal operation of the remaining sheet at the nip portion 203. After the conveyance by the after sheet jam conveyance unit 114 is completed, the printer controller management unit 119 informs the cleaning operation execution possibility determining unit 116 of the completion of the conveyance.

In S203, the cleaning operation execution possibility determining unit 116 determines whether or not the completion of the conveyance is informed from the printer controller management unit 119. In S203, in a case where the cleaning operation execution possibility determining unit 116 determines that the completion of the conveyance is informed, the processing proceeds to S004, and in a case where the cleaning operation execution possibility determining unit 116 determines that the completion of the conveyance is not informed, the processing proceeds to S204. In S204, the cleaning operation execution possibility determining unit 116 determines whether or not a new sheet jam has occurred during conveyance of the remaining sheet by the after sheet jam conveyance unit 114. In S204, in a case where the cleaning operation execution possibility determining unit 116 determines that a new sheet jam has occurred, the cleaning operation execution possibility determining unit 116 does not determine whether the cleaning operation is possible or impossible. That is, the cleaning operation execution possibility determining unit 116 interrupts the determination of whether or not the cleaning operation is possible, and the processing ends. In this manner, even if a new sheet jam occurs while the remaining sheet at the nip portion 203 is being conveyed, the cleaning operation is not started until conveyance of the remaining sheet from the nip portion 203 is completed. Therefore, an interrupting operation of the cleaning operation does not occur. Accordingly, it is possible to reduce the operation sound generated by the activation and stoppage of members related to the cleaning operation. In S204, in a case where the cleaning operation execution possibility determining unit 116 determines that a new sheet jam has not occurred, the processing returns to S203.

<Case 2>

A description will be given below of the control in a case where a double-side reverse retention-jam occurs, and the sheet P remaining in the printer 100 is in the state of FIG. 9A. In Case 2, the sheet removal possibility determining unit 111 determines whether or not the remaining sheet can be removed from the nip portion 203 by using the sheet length of a jammed sheet, the position of other remaining sheets, etc.

Figure 9B:
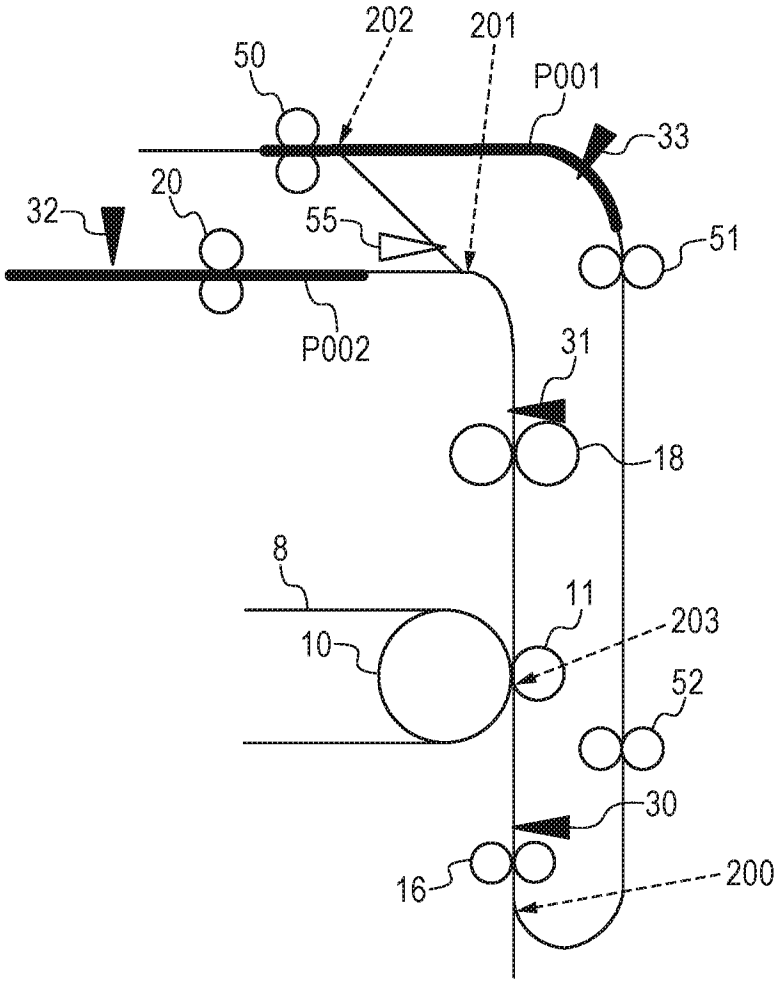
FIG. 9A and FIG. 9B are diagrams illustrating the position of a recording medium in the image forming apparatus of Example 3.

First, FIG. 9A and FIG. 9B will be described. FIG. 9A is a diagram illustrating the position of the remaining sheet in the printer 100 immediately after a sheet jam is detected. P001 indicates a jammed sheet, and the jammed sheet is hereinafter referred to as the jammed sheet P001. P002 indicates the subsequent sheet P that is fed following P001, and the subsequent sheet P is hereinafter referred to as the subsequent sheet P002. FIG. 9B is a diagram illustrating the position of the remaining sheet in the printer 100 in a case where the subsequent sheet P002 remaining at the nip portion 203 is removed from the nip portion 203, and the cleaning operation is made possible before the jam clear by the user. In Case 2, it is assumed that the printer control unit 101 detects a double-side reverse retention-jam of the jammed sheet P001, 200 ms after the timing at which the detection result of the fixing unit discharge sensor 31 is changed from "no sheet exists" to "sheet exists" for the subsequent sheet P002. This means that the tip of the subsequent sheet P002 is located in the downstream of the fixing unit discharge sensor 31 for the distance the tip of the subsequent sheet P002 is conveyed during 200 ms. Further, in order to perform printing on the second page, let the subsequent sheet P002 be the sheet P that is conveyed in the reverse point 202 direction. It is assumed that the sheet lengths of the jammed sheet P001 and the subsequent sheet P002 are each 216 mm.

Figure 9A:
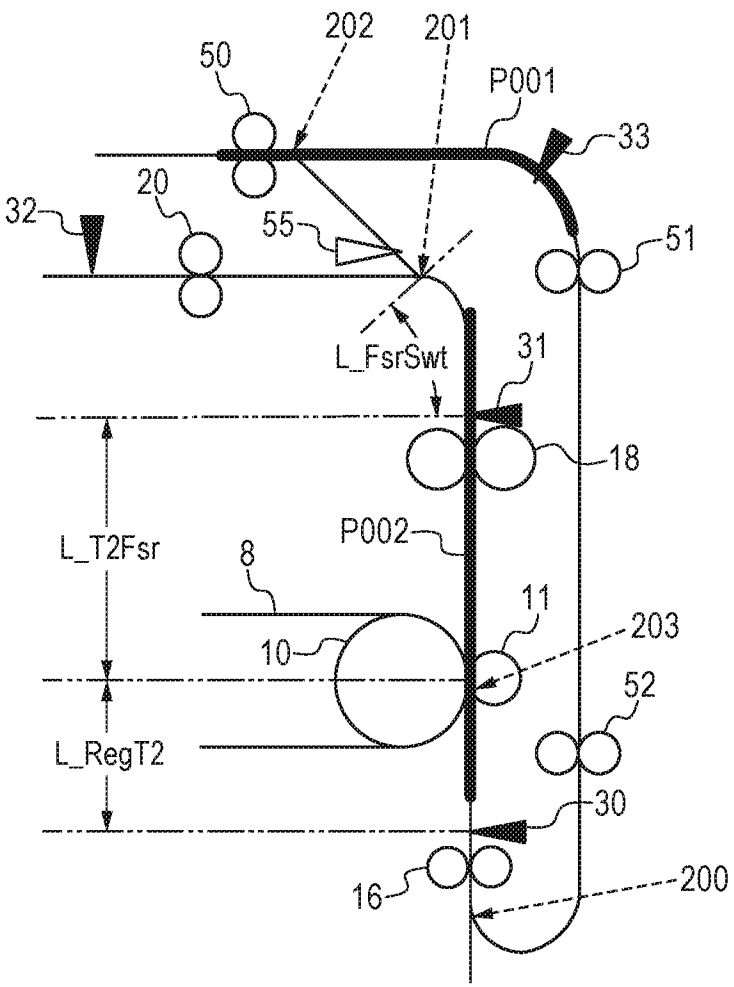

Then, the signs in FIG. 9A are described. As for the signs that have been already described, the same numbers are used, and a description thereof will be omitted.

L_FsrSwt: the distance from the fixing unit discharge sensor 31 to the branching point 201

In Example 3, the distance is 60 mm.

A detailed description will be given below of the determinations by the sheet removal possibility determining unit 111 and the sheet position determining unit 112 at the time of the determination in S202 of FIG. 8. Note that, at the time when a sheet jam is detected, the sheet position determining unit 112 determines that the subsequent sheet P002 exists at the nip portion 203 by sheet existence/non-existence timing determination at the nip portion 203. Since a double-side reverse retention-jam has occurred, the sheet removal possibility determining unit 111 determines that driving of the reverse roller pair 50 and the double-side conveyance first roller pair 51 is impossible. Here, in order to normally convey the sheet P, the sheet length needs to be longer than the distance between a predetermined roller pair on the conveyance path, and a roller pair provided in the downstream of the predetermined roller pair in the conveyance direction and provided next to the predetermined roller pair in the conveyance order. Therefore, there is a possibility that the jammed sheet causing a retention jam is sandwiched by both a roller pair that is in the upstream in the conveyance direction of a sensor, and a roller pair that is the downstream of the sensor in the conveyance direction. Therefore, the sheet removal possibility determining unit 111 determines that driving of the reverse roller pair 50 and the double-side conveyance first roller pair 51 is impossible.

Further, the sheet removal possibility determining unit 111 determines whether or not the subsequent sheet P002 can be removed from the nip portion 203. The subsequent sheet P002 is being normally conveyed. Therefore, the sheet position determining unit 112 determines whether or not the tip of the subsequent sheet P002 is located in the upstream of the branching point 201, based on the time until the fixing unit discharge sensor 31 detects a sheet jam after detecting the sheet existence of the subsequent sheet P002, L_FsrSwt and the conveyance speed. As described above, in Case 2, the double-side reverse retention-jam is detected 200 ms after the fixing unit discharge sensor 31 detects the existence of the subsequent sheet P002. Further, it is assumed that the conveyance speed of the subsequent sheet P002 is 200 mm/s.

Therefore, the sheet position determining unit 112 determines that the tip of the subsequent sheet P002 is 40 mm (=0.2 s×200 mm/s) downstream from the fixing unit discharge sensor 31. Since the distance between the fixing unit discharge sensor 31 and the tip position of the subsequent sheet P002 is shorter than L_FsrSwt(=60 mm), the sheet position determining unit 112 determines that the tip of the subsequent sheet P002 is in the upstream of the branching point 201. The sheet length of the subsequent sheet P002 is shorter than the tip position of the subsequent sheet P002+L_T2Fsr+L_RegT2 (=40 mm+150 mm+30 mm). Therefore, the sheet removal possibility determining unit 111 determines that the subsequent sheet P002 is sandwiched by the fixing device 18 and the nip portion 203. The jammed sheet is not sandwiched by these rollers, i.e., the fixing device 18 and the nip portion 203. Therefore, the sheet removal possibility determining unit 111 switches the double-side flapper 55 to a discharge direction, and determines that the subsequent sheet P002 can be conveyed by the secondary transfer roller 11, the fixing device 18, and the discharge roller pair 20. In this manner, the sheet removal possibility determining unit 111 determines that the subsequent sheet P002 can be discharged to the outside of the apparatus (outside of the image forming apparatus), i.e., the subsequent sheet P002 can be removed from the nip portion 203.

Note that, in Case 2, the timing at which the printer controller management unit 119 informed the cleaning operation execution possibility determining unit 116 of the completion of the conveyance is the following timing. That is, it is the timing after the conveyance by the after sheet jam conveyance unit 114 is completed, i.e., after discharging the remaining sheet to the outside of the apparatus in the downstream of the nip portion 203 is stopped, or after conveyance of the remaining sheet within the double-side conveyance path in the downstream of the nip portion 203 is stopped. However, in a case where the remaining sheet can be removed from the nip portion 203, even if a new sheet jam occurs thereafter, the cleaning operation can be performed. Therefore, the printer controller management unit 119 may be configured to inform the cleaning operation execution possibility determining unit 116 of the completion of the conveyance, at the timing at which it is possible to determine that neither a jammed sheet nor other remaining sheet exists at the nip portion 203, even if a new sheet jam occurs during the conveyance by the after sheet jam conveyance unit 114. Here, the timing at which it is possible to determine that neither a jammed sheet nor other remaining sheet exists at the nip portion 203 is the following timing. That is, the timing at which, even if a new sheet jam occurs after that time point, it is determined that the sheets (the jammed sheet and the remaining sheet) do not exist at the nip portion 203 in S001 and S002 of FIG. 8, and the processing proceeds to S204 without transitioning to S202. The same applies to the subsequent cases.

Additionally, in Case 2, the example has been illustrated in which there is no other third sheet between the jammed sheet and the remaining sheet at the nip portion 203. Example 3 is not limited to this configuration, and the third sheet may exist. In that case, the position of the third sheet is determined based on the timing at which each sensor detects the existence/non-existence of the third sheet, and the sheet removal possibility determining unit 111 performs similar determination based on the interval between the sheets. Additionally, the configuration may be adopted in which it is determined that, by conveying the remaining sheet and the third sheet at the nip portion 203, whether or not each of the sheets can be removed from the nip portion 203 without collision between the sheets. The third sheet may also exist in the subsequent cases.

<Case 3>

Figure 10B:
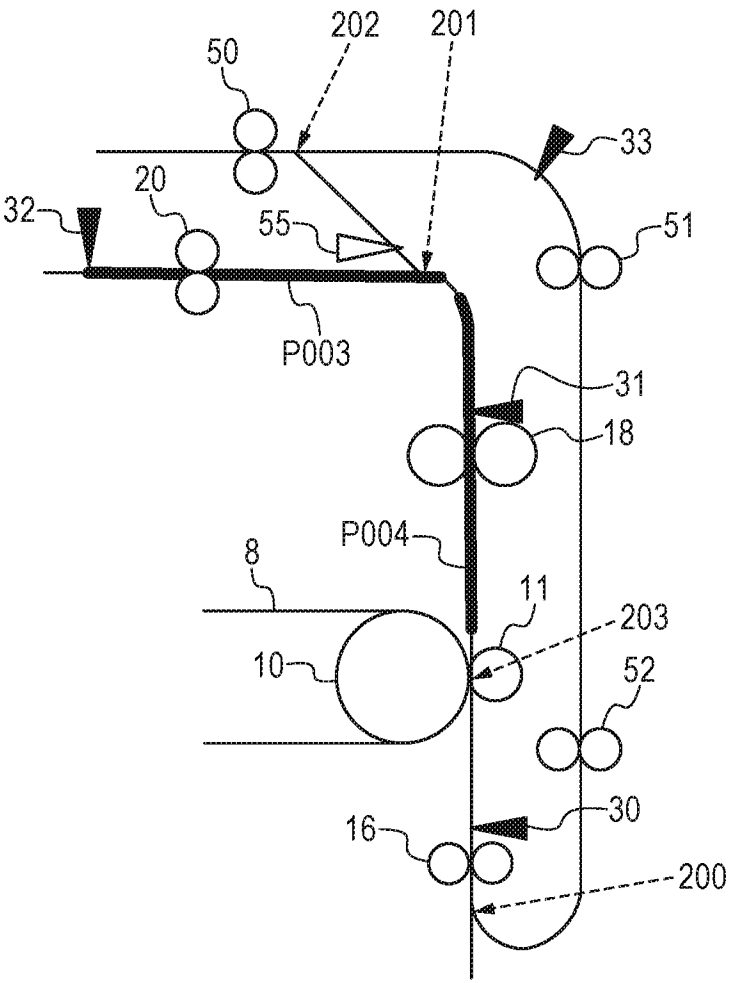
FIG. 10A and FIG. 10B are diagrams illustrating the position of the recording medium in the image forming apparatus of Example 3.
Figure 10A:
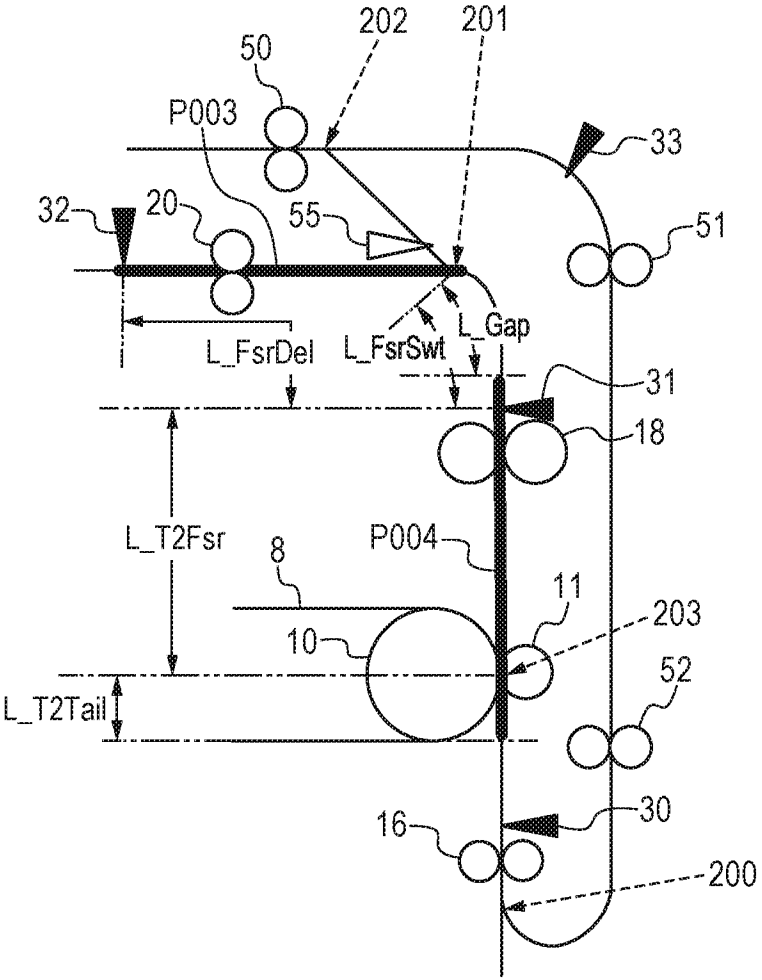

A description will be given below of the control in a case where a discharge retention-jam occurs, and the sheet P remaining in the printer 100 is in the state of FIG. 10A. In Case 3, the sheet removal possibility determining unit 111 determines that the sheet P remaining at the nip portion 203 will remain inside the apparatus, but can be removed from the nip portion 203.

First, FIG. 10A and FIG. 10B will be described. FIG. 10A is a diagram indicating the position of the remaining sheet in the printer 100 immediately after a sheet jam is detected. P003 is a jammed sheet, and the jammed sheet is hereinafter referred to as the jammed sheet P003. P004 is a subsequent sheet that is fed following the jammed sheet P003, and the subsequent sheet is hereinafter referred to as the subsequent sheet P004. FIG. 10B is a diagram illustrating the position of the remaining sheet in the printer 100 in a case where the subsequent sheet P004 remaining at the nip portion 203 is removed from the nip portion 203, and the cleaning operation is made possible before the jam clear by the user.

In Case 3, it is assumed that the printer control unit 101 detects a discharge retention-jam of the jammed sheet P003, 10 ms after the detection result of the fixing unit discharge sensor 31 is changed from "no sheet exists" to "sheet exists" for the subsequent sheet P004. This means that the tip of the subsequent sheet P002 is located in the downstream of the fixing unit discharge sensor 31 for the distance the tip of the subsequent sheet P002 is conveyed during 10 ms. It is assumed that the sheet lengths of the jammed sheet P003 and the subsequent sheet P004 are 160 mm.

Next, the signs in FIG. 10A will be described. As for the signs that have been already described, the same numbers are used, and a description thereof will be omitted.

L_Gap: the distance between the trailing edge of the jammed sheet P003 at the time of sheet jam detection, and the tip of the subsequent sheet P004 (hereinafter referred to as between the sheets)

L_T2Tail: the distance between the trailing edge of the subsequent sheet P004 and the nip portion 203

Specific lengths will be described within the following description.

A detailed description will be given below of the determinations by the sheet removal possibility determining unit 111 and the sheet position determining unit 112 at the time of the determination in S202 of FIG. 8. Note that, at the time when a sheet jam is detected, the sheet position determining unit 112 determines that the subsequent sheet P004 exists at the nip portion 203, based on the sheet existence/non-existence timing determination at the nip portion 203.

The sheet position determining unit 112 determines that the tip of the jammed sheet P003 is in the downstream of the discharge sensor 32, since a discharge retention-jam has occurred. Since the jammed sheet P003 is detected by the discharge sensor 32, the sheet position determining unit 112 determines that the tip of the jammed sheet P003 is at a position in the downstream of the discharge sensor 32. In addition, the distance from the branching point 201 to the discharge sensor 32 (L_FsrDel−L_FsrSwt=200 mm−60 mm=140 mm) is shorter than the sheet length of the jammed sheet P003 (160 mm). Therefore, the sheet position determining unit 112 determines that the trailing edge of the jammed sheet P003 may be located in the upstream of the branching point 201. Additionally, the sheet length of the jammed sheet P003 (160 mm) is shorter than the distance between the discharge sensor 32 and the nip portion 203 (L_FsrDel+L_T2Fsr=200 mm+150 mm=350 mm). Therefore, the sheet position determining unit 112 determines that the jammed sheet P003 does not exist at the nip portion 203. Similarly, since the sheet length is shorter than L_FsrDel, the sheet position determining unit 112 determines that the jammed sheet P003 is not sandwiched by the fixing device 18.

Since the discharge retention-jam has occurred, the sheet removal possibility determining unit 111 determines that driving of the discharge roller pair 20 is impossible. However, since the jammed sheet P003 is not sandwiched by the fixing device 18, the sheet removal possibility determining unit 111 determines that the fixing device 18 can be driven. Therefore, the sheet removal possibility determining unit 111 determines that the subsequent sheet P004 at the nip portion 203 can be conveyed by driving the drive roller 9 and the fixing device 18. However, since there is a possibility that the jammed sheet P003 remains at the branching point 201, the sheet removal possibility determining unit 111 determines that the subsequent sheet P004 cannot be conveyed to the direction of the reverse roller pair 50. This is because the sheet removal possibility determining unit 111 determines that, if the subsequent sheet P004 is conveyed to the direction of the reverse roller pair 50 by switching the double-side flapper 55 to the reverse part direction, the subsequent sheet P004 can collide with the jammed sheet P003 whose trailing edge is in the upstream of the branching point 201.

Next, the position of the subsequent sheet P004 will be described. A sheet jam is detected 10 ms after the detection result of the fixing unit discharge sensor 31 is changed from "no sheet exists" to "sheet exists" for the subsequent sheet P004. Therefore, the sheet position determining unit 112 determines that the tip of the subsequent sheet P004 is at the position that is 2 mm (=0.01 s×200 mm/s) from the fixing unit discharge sensor 31. Considering the distance of L_FsrDel, the positions of the jammed sheet P003 and the subsequent sheet P004, and the sheet length, the sheet position determining unit 112 performs determination as follows. That is, the sheet position determining unit 112 determines that L_Gap is at least 38 mm (L_FsrDel−the sheet length of the jammed sheet P003−the distance between the fixing unit discharge sensor 31 and the tip of the subsequent sheet P004=200 mm−160 mm−2 mm). Additionally, the sheet position determining unit 112 determines as follows from the position of the tip of the subsequent sheet P004, the sheet length of the subsequent sheet P004, and L_T2Fsr. That is, the sheet position determining unit 112 determines that the trailing edge of the subsequent sheet P004 is at the position that is 8 mm upstream from the nip portion 203 (the sheet length−the distance between the fixing unit discharge sensor 31 and the tip of the subsequent sheet P004−L_T2Fsr=160 mm−2 mm−150 mm). Note that this distance corresponds to L_T2Tail described above.

From the above, L_T2Tail (8 mm) is smaller than L_Gap (38 mm). Therefore, the sheet removal possibility determining unit 111 determines that the subsequent sheet P004 can be removed from the nip portion 203 without colliding with the jammed sheet P003, by reducing the distance between the jammed sheet P003 and the subsequent sheet P004 by driving the fixing device 18 and the secondary transfer roller 11. In this manner, in a case where, even if a remaining sheet is conveyed so that the trailing edge of the remaining sheet escapes from the nip portion 203, the remaining sheet does not collide with the jammed sheet, the printer controller management unit 119 conveys the remaining sheet to the downstream in the conveyance direction so that the trailing edge of the remaining sheet escapes from the nip portion 203.

The printer controller management unit 119 instructs the after sheet jam conveyance unit 114 to drive the fixing device 18 and the secondary transfer roller 11 by a distance equal to or more than L_T2Tail and less than L_Gap. Consequently, the subsequent sheet P004 is removed from the nip portion 203. The printer controller management unit 119 informs the cleaning operation execution possibility determining unit 116 of the completion of the conveyance, when the conveyance by the after sheet jam conveyance unit 114 is completed.

Further, in Case 3, the switching time of the double-side flapper 55 is set to 0 ms, and the sheet removal possibility determining unit 111 does not consider the switching time of the double-side flapper 55 when performing the determination. Example 3 is not limited to this configuration. For example, the sheet removal possibility determining unit 111 may compare the tip position of the subsequent sheet P004 with the position that is in the upstream of the branching point 201 by the switching time of the double-side flapper 55, and may determine whether or not the subsequent sheet P004 can be conveyed to the reverse point 202 direction.

<Case 4>

Figure 11B:
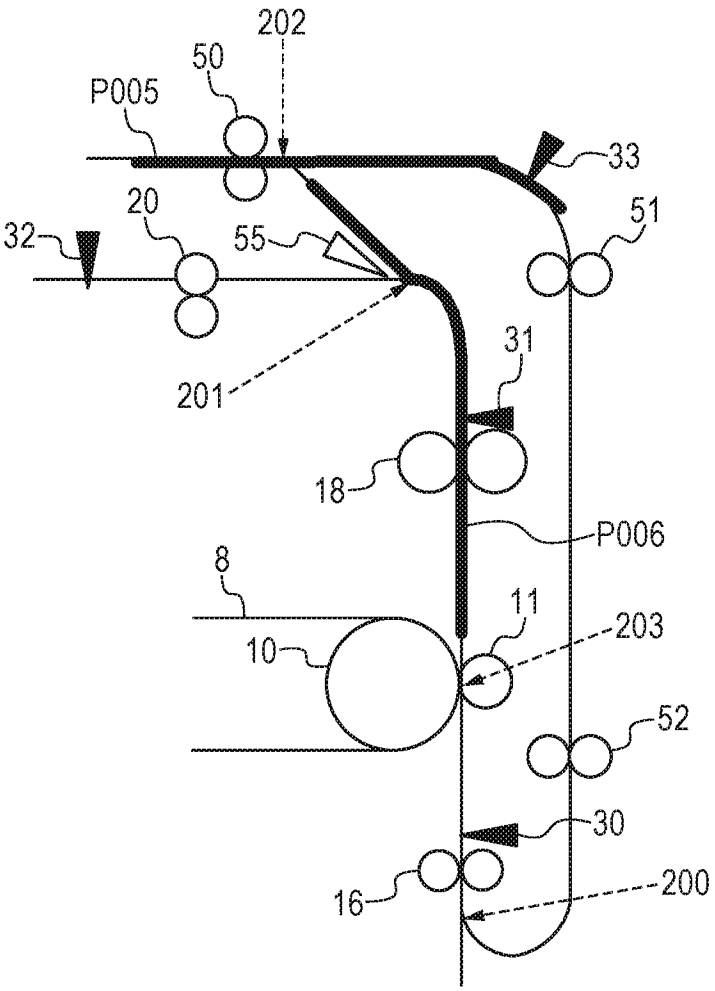
FIG. 11A and FIG. 11B are diagrams showing the position of the recording medium in the image forming apparatus of Example 3.
Figure 11A:
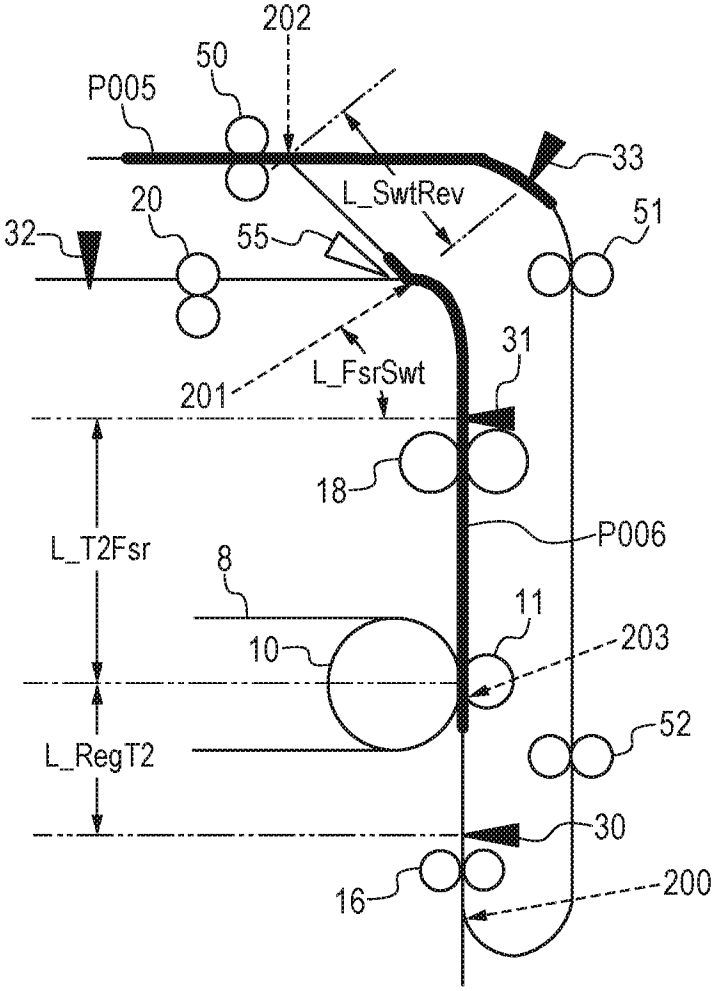

A description will be given below of the control in a case where a double-side reverse retention-jam occurs, and a sheet remaining in the printer 100 is in the state of FIG. 11A. In Case 4, the sheet removal possibility determining unit 111 determines whether or not the sheet P can be removed from the nip portion 203, irrespective of the sheet length of a jammed sheet.

First, FIG. 11A and FIG. 11B will be described. FIG. 11A is a diagram illustrating the position of the remaining sheet in the printer 100 immediately after a sheet jam is detected. P005 is a jammed sheet, and the jammed sheet is hereinafter referred to as the jammed sheet P005. P006 is a subsequent sheet that is fed following the jammed sheet P005, and the subsequent sheet is hereinafter referred to as the subsequent sheet P006. FIG. 11B is a diagram illustrating the position of the remaining sheet in the printer 100 in a case where the subsequent sheet P006 remaining in the nip portion 203 is removed from the nip portion 203, and the cleaning operation is made possible before the jam clear by the user.

A description will be given below of an example in which the sheet removal possibility determining unit 111 determines that the sheet P can be removed from the nip portion 203 by changing the state from FIG. 11A to FIG. 11B. In Case 4, it is assumed that the subsequent sheet P006 is a sheet that is sent to the reverse point 202 direction in order to perform printing on the second page. Additionally, it is assumed that the printer control unit 101 detects a double-side reverse retention-jam of the jammed sheet P005, 320 ms after the detection result of the fixing unit discharge sensor 31 is changed from "no sheet exists" to "sheet exists" for the subsequent sheet P006. This means that the tip of the subsequent sheet P006 is located in the downstream of the fixing unit discharge sensor 31 by a distance the tip of the subsequent sheet P006 is conveyed during 320 ms. It is assumed that the sheet length of the subsequent sheet P006 is 216 mm.

Next, the signs in FIG. 11A will be described. As for the signs that have been already described, the same numbers are used, and a description thereof will be omitted.

L_SwtRev: the distance between the branching point 201 and the reverse point 202

In Example 3, the distance is 40 mm.

A detailed description will be given below of the determinations by the sheet removal possibility determining unit 111 and the sheet position determining unit 112 at the time of the determination in S202 of FIG. 8. Note that, at the time when a sheet jam is detected, the sheet position determining unit 112 determines that the subsequent sheet P006 exists at the nip portion 203, based on the sheet existence/non-existence timing determination at the nip portion 203.

Since a double-side reverse retention-jam has occurred, the sheet position determining unit 112 determines that it is after the jammed sheet P005 passes the reverse point 202, and the jammed sheet P005 does not exist at the nip portion 203. The sheet position determining unit 112 determines that the jammed sheet P005 does not exist between the branching point 201 and the reverse point 202, since it is after the jammed sheet P005 reaches the double-side reverse sensor 33.

Regarding the position of the subsequent sheet P006, the sheet position determining unit 112 detected the double-side reverse retention-jam of the jammed sheet P005, 320 ms after the detection result of the fixing unit discharge sensor 31 is changed from "no sheet exists" to "sheet exists" for the subsequent sheet P006. Therefore, the sheet position determining unit 112 determines that the tip of the subsequent sheet P006 is at the position in the downstream of the fixing unit discharge sensor 31 by 64 mm (=0.32 s×200 mm/s). The distance between the tip of the subsequent sheet P006 and the fixing unit discharge sensor 31 is larger than L_FsrSwt (=60 mm). Therefore, the sheet position determining unit 112 determines that the subsequent sheet P006 is at the position after being conveyed by the double-side flapper 55 to the reverse point 202 direction. The sheet position determining unit 112 determines that the tip of the subsequent sheet P006 is in the downstream of the branching point 201 by 4 mm (=64 mm−60 mm).

Further, the sheet position determining unit 112 determines that the trailing edge of the subsequent sheet P006 is at the position that is 2 mm upstream from the nip portion 203, from the tip position of the subsequent sheet P006, the sheet length, and the distance of L_T2Fsr. Here, the sheet position determining unit 112 determines that the tip position of the subsequent sheet P006 is 2 mm upstream from the nip portion 203, since the sheet length−the tip position−L_T2Fsr=216 mm−64 mm−150 mm.

Since the sheet jam that occurred is the double-side reverse retention-jam, the sheet removal possibility determining unit 111 determines that driving of the reverse roller pair 50 and the double-side conveyance first roller pair 51 is impossible. Additionally, the sheet removal possibility determining unit 111 determines that, even if the double-side flapper 55 is switched, the subsequent sheet P006 cannot be conveyed to the discharge roller pair 20 direction and discharged to the outside of the apparatus, since the tip of the subsequent sheet P006 is between the branching point 201 and the reverse point 202. However, the distance between the tip position of the subsequent sheet P006 and the reverse point 202 (36 mm) is larger than the distance between the nip portion 203 and the trailing edge of the subsequent sheet P006 (2 mm). Therefore, the sheet removal possibility determining unit 111 determines that the subsequent sheet P006 can be removed from the nip portion 203 without colliding with the jammed sheet P005, by conveying the subsequent sheet P006 to the reverse point 202 direction.

Subsequently, the printer controller management unit 119 instructs the after sheet jam conveyance unit 114 to drive the fixing device 18 and the secondary transfer roller 11. On this occasion, the distance the subsequent sheet P006 is conveyed by driving is equal to or more than the distance between the nip portion 203 and the subsequent sheet P006 (2 mm), and is less than the distance from the tip position of the subsequent sheet P006 to the reverse point 202 (L_SwtRev−4 mm=36 mm). In this manner, the subsequent sheet P006 is removed from the nip portion 203.

<Case 5>

A description will be given below of the control in a case where a fixing unit discharge retention-jam occurs, and a sheet remaining in the printer 100 is in the state of FIG. 12A. In Case 5, the intermediate transfer belt 8 is configured to be rotatable in the direction opposite to the rotation direction of an arrow A in FIG. 1, and is configured to be able to convey the remaining sheet at the nip portion 203 to the upstream side of the conveyance direction. Consequently, even in a case where the sheet P remaining at the nip portion 203 cannot be conveyed to the downstream in the conveyance direction, the sheet P can be removed from the nip portion 203 by conveying the sheet P to the upstream.

In Case 5, the intermediate transfer motor 140 can be rotated in the direction opposite to the direction during the image forming operation. By rotating the intermediate transfer motor 140 in the opposite direction, the drive roller 9 and the intermediate transfer belt 8 are rotated in the direction opposite to the direction during the image forming operation (the opposite direction of the arrow A in FIG. 1). Similarly, the registration roller pair 16 and the registration motor 141, which are provided in the upstream of at least the nip portion 203, are also rotated in the direction opposite to the conveyance direction during the image forming operation.

Figure 12B:
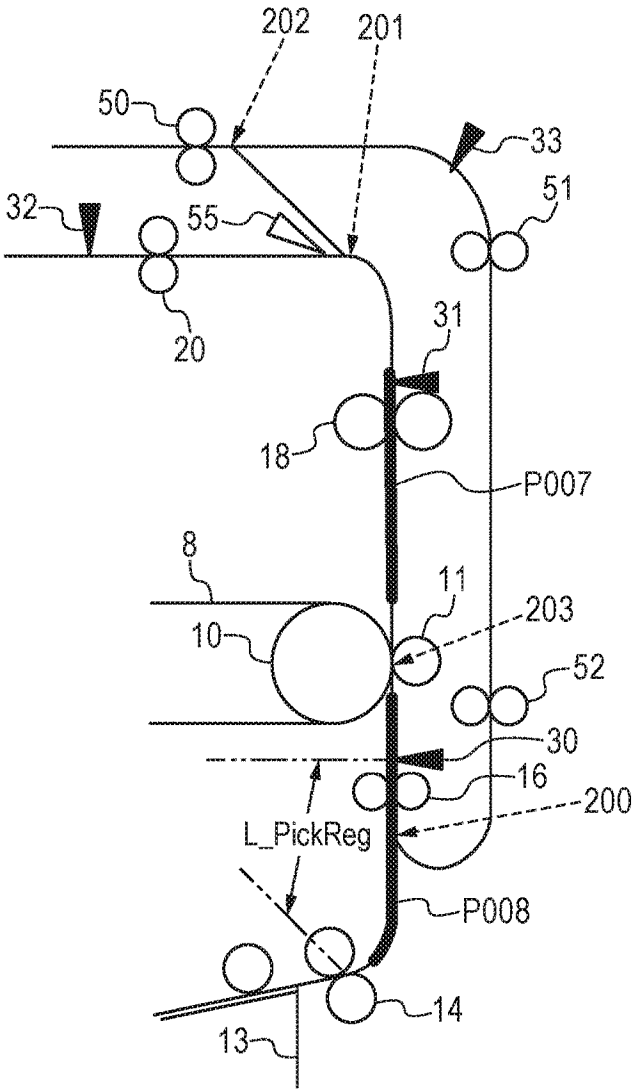
FIG. 12A and FIG. 12B are diagrams showing the position of the recording medium in the image forming apparatus of Example 3.

First, FIG. 12A and FIG. 12B will be described. FIG. 12A is a diagram indicating the position of the remaining sheet in the printer 100 immediately after a sheet jam is detected. P007 is a jammed sheet, and the jammed sheet is hereinafter referred to as the jammed sheet P007. P008 is a subsequent sheet that is fed following the jammed sheet P007, and the subsequent sheet is hereinafter referred to as the subsequent sheet P008. FIG. 12B is a diagram indicating the position of the remaining sheet in the printer 100 in a case where the subsequent sheet P008 remaining in the nip portion 203 is removed to the upstream from the nip portion 203, and the cleaning operation is made possible before the jam clear by the user.

A description will be given of an example in which the sheet removal possibility determining unit 111 determines that the sheet P can be removed from the nip portion 203 by changing the state from FIG. 12A to FIG. 12B. In Case 5, it is assumed that the printer control unit 101 detects a fixing unit discharge retention-jam of the jammed sheet P007, 160 ms after the detection result of the registration sensor 30 is changed from "no sheet exists" to "sheet exists" for the subsequent sheet P008. This means that the tip of the subsequent sheet P008 is located in the downstream of the registration sensor 30 by a distance the tip of the subsequent sheet P008 is conveyed during 160 ms. It is assumed that the sheet lengths of the jammed sheet P007 and the subsequent sheet P008 are 140 mm. Additionally, it is assumed that the sheet P following the subsequent sheet P008 is not fed.

Figure 12A:
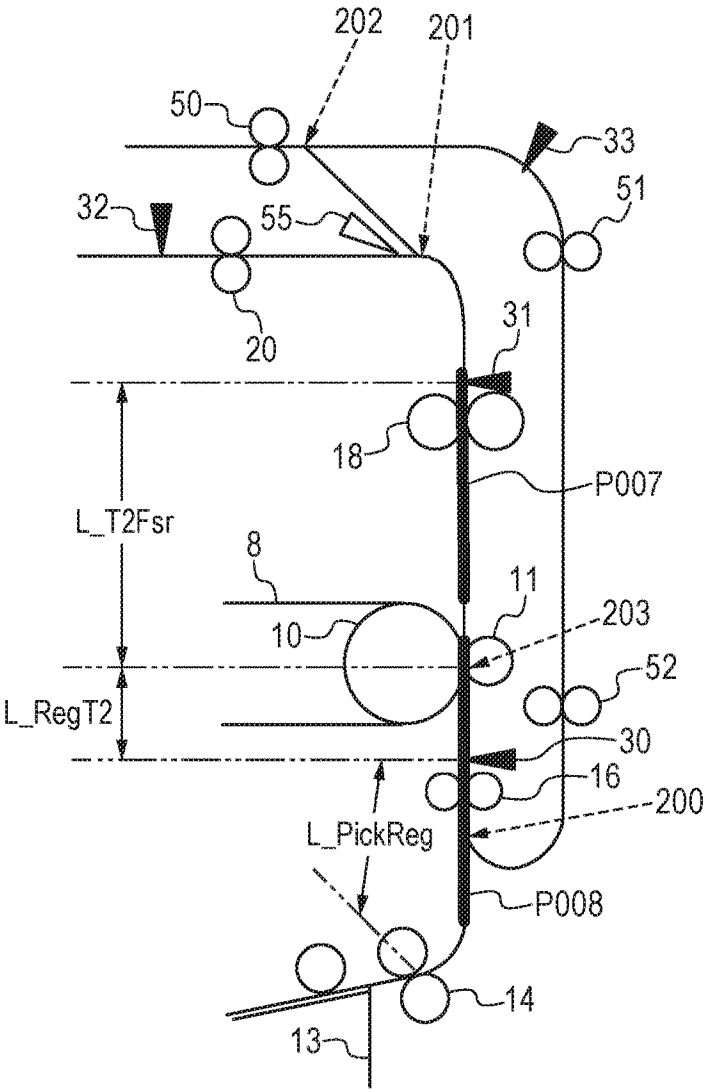

Next, the signs in FIG. 12A are described. As for the signs that have been already described, the same numbers are used, and a description thereof will be omitted.

L_PickReg: the distance between the feeding roller pair 14 and the registration sensor 30

In Example 3, the distance is 120 mm.

A detailed description will be given of the determinations by the sheet removal possibility determining unit 111 and the sheet position determining unit 112 at the time of the determination in S202 of FIG. 8. The sheet position determining unit 112 determines that the tip of the jammed sheet P007 is the downstream of the fixing unit discharge sensor 31, since a fixing unit discharge retention-jam has occurred. The sheet position determining unit 112 determines that the jammed sheet does not exist at the nip portion 203, since the sheet length of the jammed sheet P007 (140 mm) is shorter than the distance between the fixing unit discharge sensor 31 and the nip portion 203 (L_T2Fsr=150 mm). Further, the sheet position determining unit 112 determines that the subsequent sheet P008 is sandwiched by the secondary transfer opposing roller 10 and the secondary transfer roller 11 at the nip portion 203, based on the sheet existence/non-existence timing determination at the nip portion 203. The sheet position determining unit 112 determines that the trailing edge of the jammed sheet P007 may be located 10 mm (=150 mm−140 mm) downstream from the nip portion 203, based on the sheet length of the jammed sheet P007 and the distance of L_T2Fsr.

Additionally, a sheet jam is detected 160 ms after the detection result of the registration sensor 30 is changed from "no sheet exists" to "sheet exists" for the subsequent sheet P008. Therefore, the sheet position determining unit 112 determines that the tip of the subsequent sheet P008 is located 2 mm downstream (0.16 s×200 mm/s−L_RegT2) from the nip portion 203, and the trailing edge of the subsequent sheet P008 is located 138 mm upstream (the sheet length−2 mm) from the nip portion 203.

The sheet removal possibility determining unit 111 determines that driving of the fixing device 18 is impossible, since a fixing unit discharge retention-jam has occurred. Considering the positional relationship between the jammed sheet P007 and the subsequent sheet P008, the distance between the trailing edge of the subsequent sheet P008 and the nip portion 203 (138 mm) is longer than the distance between the trailing edge position of the jammed sheet P007 and the tip position of the subsequent sheet P008 (10 mm−2 mm=8 mm). Therefore, the sheet removal possibility determining unit 111 determines that, in a case where the subsequent sheet P008 is conveyed to the downstream, the subsequent sheet P008 will collide with the jammed sheet P007 before there is no sheet at the nip portion 203. However, the distance between the nip portion 203 and the feeding roller pair 14 (L_PickReg+L_RegT2=120 mm+30 mm=150 mm) is longer than the sheet length of the subsequent sheet P008 (140 mm). Therefore, the sheet removal possibility determining unit 111 determines that the subsequent sheet P008 can be removed from the nip portion 203 by conveying the subsequent sheet P008 to the upstream.

Additionally, the printer controller management unit 119 instructs the after sheet jam conveyance unit 114 as follows. The printer controller management unit 119 instructs the after sheet jam conveyance unit 114 to reversely rotate the drive roller 9 and the registration roller pair 16 by a distance that is equal to or more than the distance between the tip of the subsequent sheet P008 and the nip portion 203 (2 mm), and less than the distance between the feeding roller pair 14 and the trailing edge of the subsequent sheet P008. Here, the distance between the feeding roller pair 14 and the trailing edge of the subsequent sheet P008 is 12 mm (=L_PickReg+L_RegT2+2 mm−the sheet length=120 mm+30 mm+2 mm−140 mm=12 mm). In this manner, the printer controller management unit 119 conveys the remaining sheet to the upstream in the conveyance direction, in a case where, even if the remaining sheet is conveyed to the opposite direction, and the tip of the remaining sheet is located in the upstream of the nip portion 203, the remaining sheet will not collide with the jammed sheet.

In addition, in Case 5, it is assumed that the drive roller 9 and the registration roller pair 16 can be rotated to the direction opposite to the direction during the image forming operation. Example 3 is not limited to this configuration, and as for the other rollers such as the feeding roller pair 14, each roller and each motor used as the driving source may be rotatable in the opposite direction. Consequently, the scope in which the sheet P remaining at the nip portion 203 can be conveyed to the upstream side can be expanded.

Additionally, in Case 5, it is assumed that there is no subsequent sheet that is fed following the subsequent sheet P008 at the nip portion 203. Example 3 is not limited to this configuration, and there may be a further subsequent sheet P that follows the subsequent sheet P008. In this case, the configuration may be adopted in which the tip position of the subsequent sheet P is determined, and the subsequent sheet P008 is conveyed to the upstream to the tip position of the subsequent sheet P. Alternatively, the configuration may be adopted in which the number of rollers that can be rotated in the opposite direction is increased, and the sheets, including the further subsequent sheet P that is fed following the subsequent sheet P008, are conveyed to the upstream side.

As described above in Cases 1 to 5, the printer controller management unit 119 performs the cleaning operation after the after sheet jam conveyance unit 114 completes the conveyance of the remaining sheet. Accordingly, since further cleaning operation is not performed after the jam clear by the user is performed, the time until the image forming operation is resumed can be reduced. Further, in Example 3, since the cleaning operation can be performed without interruption, the frequency at which unnecessary operation sound is generated can be reduced.

As described above, according to Example 3, the waiting time for the user until the image forming operation is resumed after the image forming operation is interrupted can be reduced.

Further, though the tandem-system color printer is used as the image forming apparatus in the above-described examples, the present invention is not limited to this printer. For example, image forming apparatuses having the other configurations, such as a monochrome printer without the intermediate transfer belt, a color printer with a conveyance belt for conveying sheets, may be used. Further, in the case of the color printer with the conveyance belt for conveying sheets, toner images on photoconductive drums are sequentially superimposed and transferred to a sheet on the conveyance belt at four transfer nip portions. That is, the color printer with the conveyance belt includes the four transfer nip portions. Therefore, the remaining sheet is moved from all the positions of the four transfer nip portions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-073417, filed Apr. 5, 2018, which is hereby incorporated by reference herein in its entirety.

What is claimed is:

1. An image forming apparatus comprising:

a conveyance unit configured to convey a recording medium, the conveyance unit provided on a conveyance path, and;

an image bearing member configured to bear a toner image to be transferred onto the recording medium;

a transfer unit configured to transfer the toner image borne by the image bearing member to the recording medium at a transfer position;

a cleaning unit configured to clean a toner on the image bearing member;

a detection unit configured to detect a jam of the recording medium occurred in the conveyance path; and a control unit configured to control the conveyance unit to stop driving of the conveyance unit, in a case where the detection unit detects that the jam of the recording medium occurred in the conveyance path, wherein, in a case where the detection unit detects that the jam of the recording medium occurred in the conveyance path, and the control unit determines that no recording medium exists at the transfer position, the control unit allows the cleaning unit to start cleaning without waiting for removal of the recording medium causing the jam.

2. An image forming apparatus according to claim 1, wherein in a case where the detection unit detects that the jam occurs, and the control unit determines that the recording medium exists at the transfer position, the control unit allows the cleaning unit to start cleaning after the recording medium is removed from the conveyance path.

3. An image forming apparatus according to claim 1, further comprising:

a determining unit configured to determine a kind of a jam that occurred in the conveyance path, wherein the control unit determines whether or not the recording medium exists at the transfer position based on the kind of the jam determined by the determining unit and a length of the recording medium in a conveyance direction.

4. An image forming apparatus according to claim 3, wherein the detection unit is provided on the conveyance path, and includes a sensor configured to detect existence/non-existence of the recording medium, and wherein the determining unit determines the kind of the jam based on a detection result by the sensor.

5. An image forming apparatus according to claim 4, wherein the sensor is located upstream of the transfer position, and wherein the control unit determines whether or not the recording medium exists at the transfer position based on the detection result by the sensor, a distance between the sensor and the transfer position, and a conveyance speed of the recording medium.

6. An image forming apparatus according to claim 4, wherein the detection unit includes a first sensor, and a second sensor provided downstream of the first sensor in the conveyance direction, and wherein the determining unit determines that the kind of the jam is a delay-jam, in a case where the existence of the recording medium is not detected by the second sensor, even if a predetermined time period passes after the first sensor detects the existence of the recording medium.

7. An image forming apparatus according to claim 4, wherein the determining unit determines that the kind of the jam is a retention-jam, in a case where the non-existence of the recording medium is not detected, even if a predetermined time period passes after the sensor detects the existence of the recording medium.

8. An image forming apparatus according to claim 1, wherein, in a case where the detection unit detects that the jam occurs, the control unit determines that the recording medium exists at the transfer position, and further, the recording medium existing at the transfer position is different from the recording medium causing the jam, when the control unit determines that a recording medium is removed at the transfer position by allowing the conveyance unit convey the recording medium existing at the transfer position, the control unit allows the cleaning unit to start cleaning without waiting for removal of the recording medium causing the jam.

9. An image forming apparatus according to claim 8, wherein the control unit allows the cleaning unit to start cleaning, after making the conveyance unit convey the recording medium existing at the transfer position to achieve the state in which no recording medium exists at the transfer position.

10. An image forming apparatus according to claim 9, wherein the control unit does not allow the cleaning unit to start cleaning, in a case where the detection unit detects that a new jam occurs before the control unit allows the conveyance unit to convey the recording medium existing at the transfer position to achieve the state in which no recording medium exists at the transfer position.

11. An image forming apparatus according to claim 9, wherein, in a case where the recording medium causing the jam is located upstream of the recording medium existing at the transfer position in the conveyance direction, the control unit allows the conveyance unit to convey the recording medium existing at the transfer position downstream in the conveyance direction.

12. An image forming apparatus according to claim 9, wherein, in a case where, even if the recording medium existing at the transfer position is conveyed and discharged to outside of the image forming apparatus by the conveyance unit, the recording medium does not collide with the recording medium causing the jam, the control unit allows the conveyance unit to discharge the recording medium existing at the transfer position to the outside of the image forming apparatus.

13. An image forming apparatus according to claim 9, wherein, in a case where, even if the recording medium existing at the transfer position is conveyed by the conveyance unit so that a trailing edge of the recording medium is located downstream of the transfer position, the recording medium does not collide with the recording medium causing the jam, the control unit allows the conveyance unit to convey the recording medium existing at the transfer position so that the trailing edge of the recording medium is located downstream of the transfer position.

14. An image forming apparatus according to claim 9, further comprising:

a double-side conveyance path for printing on a second page that is different from a first page of the recording medium on which an image is formed, wherein, in a case where, even if the recording medium existing at the transfer position is conveyed by the conveyance unit toward the double-side conveyance path, the recording medium does not collide with the recording medium causing the jam, the control unit allows the conveyance unit to convey the recording medium existing at the transfer position toward the double-side conveyance path.

15. An image forming apparatus according to claim 9, wherein the image bearing member is configured to rotate in a direction opposite to a rotation direction in an image forming operation, wherein the conveyance unit provided upstream of at least the transfer position is configured to convey the recording medium to a direction opposite to the conveyance direction, and wherein, in a case where, even if the recording medium existing at the transfer position is conveyed by the conveyance unit so that a tip of the recording medium is located upstream of the transfer position, the recording medium does not collide with the recording medium causing the jam, the control unit allows the conveyance unit to convey the recording medium existing at the transfer position so that the tip of the recording medium is located upstream of the transfer position.

* * * * *